US010724275B2

(12) United States Patent
Curtis et al.

(10) Patent No.: US 10,724,275 B2
(45) Date of Patent: Jul. 28, 2020

(54) LOCKING APPARATUS FOR A ROLLUP DOOR OR OTHER MOVABLE OBJECT

(71) Applicant: Janus International Group, LLC, Temple, GA (US)

(72) Inventors: David Bryan Curtis, Villa Rica, GA (US); Adam David Nyman, Villa Rica, GA (US); Jason Asher Bernstein, Alpharetta, GA (US)

(73) Assignee: Janus International Group, LLC, Temple, GA (US)

( * ) Notice: Subject to any disclaimer, the term of this patent is extended or adjusted under 35 U.S.C. 154(b) by 506 days.

(21) Appl. No.: 15/722,891

(22) Filed: Oct. 2, 2017

(65) Prior Publication Data

US 2018/0023322 A1 Jan. 25, 2018

Related U.S. Application Data

(63) Continuation of application No. 14/329,421, filed on Jul. 11, 2014, now Pat. No. 9,777,512, which is a (Continued)

(51) Int. Cl.

| | |
|---|---|
| ***E05B 63/00*** | (2006.01) |
| ***E05B 47/06*** | (2006.01) |
| ***E05B 17/22*** | (2006.01) |
| ***E05C 3/24*** | (2006.01) |
| ***E05B 65/00*** | (2006.01) |
| ***E05B 15/02*** | (2006.01) |
| ***E05B 47/00*** | (2006.01) |
| *G07C 9/00* | (2020.01) |

(52) U.S. Cl.

CPC ..... *E05B 63/0052* (2013.01); *E05B 15/0295* (2013.01); *E05B 17/22* (2013.01); *E05B 47/0004* (2013.01); *E05B 47/0607* (2013.01); *E05B 65/0021* (2013.01); *E05C 3/24* (2013.01); *E05B 2047/0074* (2013.01); *E05B 2047/0094* (2013.01); *G07C 9/00563* (2013.01); *Y10T 292/1046* (2015.04)

(58) Field of Classification Search

CPC ..... Y10T 292/1047; Y10T 70/7062; Y10T 70/65; Y10T 70/7102; Y10T 70/5978; Y10T 70/7051; Y10T 292/1046; E05B 81/08; Y10S 292/36; Y10S 70/11

See application file for complete search history.

(56) References Cited

U.S. PATENT DOCUMENTS

| | | | |
|---|---|---|---|
| 654,383 | A | 7/1900 | Carleton |
| 1,199,199 | A | 9/1916 | Mason |

(Continued)

OTHER PUBLICATIONS

Search Report and Written Opinion for International Patent Application No. PCT/US/2012/033285; Jul. 13, 2012.

*Primary Examiner* — Mark A Williams

(74) *Attorney, Agent, or Firm* — Barnes & Thornburg LLP; Jason Bernstein

(57) ABSTRACT

A locking apparatus for a rollup door, comprising a striker member, latch assembly including a latch, a release lever, a trigger, a cam and a solenoid. The latch assembly may also include a limit switch for detecting when the latch assembly is in an unlocked position. The locking apparatus can be electronically unlocked or it can be unlocked manually by a user by actuating the solenoid which causes the latch to release the locked striker member.

12 Claims, 36 Drawing Sheets

Related U.S. Application Data continuation-in-part of application No. 13/086,895, filed on Apr. 14, 2011, now Pat. No. 8,789,859.

(56) References Cited

U.S. PATENT DOCUMENTS 3,111,339 A 11/1963 Nadeau
3,325,203 A 6/1967 Moler
3,620,560 A 11/1971 Peters
3,667,791 A 6/1972 Kazaoka et al.
3,733,861 A 5/1973 Lester
3,917,330 A 11/1975 Quantz
3,942,828 A * 3/1976 Bourrie ..... E05B 17/2011 292/201
3,955,840 A * 5/1976 Rawls ..... E05B 47/0002 292/229
4,030,322 A 6/1977 Pettit
4,132,177 A 1/1979 Funk
4,268,076 A * 5/1981 Itoi ..... E05B 65/461 292/201
4,468,545 A 8/1984 Slavin
4,869,536 A 9/1989 Kleefeldt
4,893,852 A 1/1990 Harris et al.
4,978,153 A 12/1990 Hirsch et al.
5,489,130 A 2/1996 Clark
5,575,515 A * 11/1996 Iwamoto ..... E05B 47/0002 221/154
5,632,317 A 5/1997 Krupke et al.
5,839,766 A 11/1998 Iannuzzi et al.
5,901,991 A * 5/1999 Hugel ..... G07C 9/00182 292/201
6,035,676 A 3/2000 Hudspeth
6,053,546 A 4/2000 Frolov
6,073,980 A 6/2000 Arabia, Jr. et al.
6,097,306 A 8/2000 Leon et al.
6,112,564 A 9/2000 Rathmann et al.
6,435,573 B1 8/2002 Szablewski
6,454,324 B1 9/2002 Lewis et al.
6,523,376 B2 2/2003 Baukholt et al.
6,659,515 B2 12/2003 Raymond et al.
7,603,882 B2 * 10/2009 Carbajal ..... A47F 3/043 70/267
8,047,582 B1 11/2011 Rodgers et al.
8,789,859 B2 * 7/2014 Curtis ..... E05B 15/0295 292/201
2003/0127867 A1 7/2003 Hale et al.
2005/0235711 A1 * 10/2005 Martin ..... E05B 65/08 70/100
2010/0109349 A1 * 5/2010 Peabody ..... E05B 47/0002 292/194
2011/0056253 A1 * 3/2011 Greiner ..... B62B 3/1404 70/85
2012/0261081 A1 10/2012 Curtis et al.
2014/0208813 A1 * 7/2014 Reeb ..... B65F 1/1615 70/277
2014/0319851 A1 * 10/2014 Curtis ..... E05B 65/0021 292/215

* cited by examiner

LOCKING APPARATUS FOR A ROLLUP DOOR OR OTHER MOVABLE OBJECT

CROSS-REFERENCE TO RELATED APPLICATIONS

This application is a continuation of co-pending U.S. patent application Ser. No. 14/329,421, filed Jul. 11, 2014, entitled LOCKING APPARATUS FOR A ROLLUP DOOR OR OTHER MOVABLE OBJECT, which is a continuation-in-part of U.S. patent application Ser. No. 13/086,895, filed Apr. 14, 2011, now U.S. Pat. No. 8,789,859, and commonly assigned to the assignee of the present application, the disclosure of which is incorporated in its entirety herein by reference.

FIELD

The present disclosure relates to locking apparatus and, in exemplary embodiments, to electronic locking apparatus for rollup or overhead doors.

BACKGROUND

FIG. 1 shows a conventional rollup door 10 (also known as an overhead door) system which typically includes first and second opposing vertical guide tracks 12, 14 which are mounted in the doorway opening. A rollup door 16 typically has a curtain 18 made of a number of connected sheets which move within the guide tracks. A bottom bar base member 20 comprising an elongated bar is at the bottom of the curtain 18. The bottom bar 20 may comprise an L-shape in cross-section having a vertical section 22 and a horizontal section 24. The bar typically has a rope 26 for manual raising and lowering from the coil side. Brackets support the door 16 and utilize a tension wheel 28 and/or associated drive mechanism (not shown) for manual and/or motor driven moving the door. A conventional door lock mechanism typically has a sliding lock bar 32 mounted to the curtain 18 and either an aperture 30 in one or both of the guide tracks 12 or 14 or a striker plate having an aperture and mounted to one of the guide tracks. When the door 16 is positioned for locking, the sliding lock bar 32 slides into the aperture 30 and the door 16 is maintained in relative position until the mechanism is unlocked. A lock, such as a combination or key lock, is manually attached to the locking bar (either directly or indirectly) to prevent unlocking by anyone other than the intended user. A sectional door, most commonly found in residential garages, comprises a set of sections which have a number of guide rollers mounted on axles which roll within the guide tracks.

One problem with such manual sliding lock systems is that the locking mechanism relies on the tenant providing an external lock which is necessarily accessible by anyone from outside of the storage unit, and which can be cut by a burglar with a bolt cutter. Another problem with a manual locking system is that if the tenant loses the key a bolt cutter is needed to be able to unlock the door. Also, in the event that a tenant fails to pay rent, the facility manager typically must add an additional lock to the locking mechanism to prevent the tenant from accessing the storage unit until the rent is paid. However, the tenant can cut the facility's lock with a bolt cutter.

It would be desirable to have a rollup door security and locking system which would eliminate the need for externally accessible mechanical locks. It would be desirable for such a system to permit remote control of access by a facility manager. It would be desirable for such a system to provide access to users by a user interface which would be more reliable than a conventional mechanical combination or key lock. It would also be desirable to have an electronic locking system that would have a manual release mechanism to allow a user to bypass the electronic lock system to manually release the door from the lock so that the door can be opened if there is a power failure.

SUMMARY

The present disclosure provides, in exemplary embodiments, a locking apparatus for remote control of the unlocking of a door, such as a rollup door.

In one exemplary embodiment, the present disclosure provides a locking apparatus, such as for a rollup door, and a generally fixed base member, wherein the locking apparatus comprises a striker member comprising a mounting portion and a latch-engaging section, the mounting portion being adapted for mounting to the door system base member; and, a latch assembly. In exemplary embodiments, the latch assembly comprises a housing comprising first and second opposing side members and at least one first opening defined in the housing adapted to receive at least a portion of the latch-engaging section. In exemplary embodiments, the latch assembly further comprises a latch comprising a body having a bore extending therethrough, a tab extending from the body, a first leg extending from the body and a second leg extending from the body, the space between the first and second legs defining a latch opening, the latch adapted to rotate about a first pin passing through the latch bore, wherein the latch is adapted to releasably engage a portion of the latch-engaging section between the first and second legs. In exemplary embodiments, the latch assembly further comprises a release lever having a first arm portion, a second arm portion and a middle portion having a bore extending therethrough, the release adapted to rotate about a second pin passing through the release lever bore. In exemplary embodiments, the latch assembly further comprises a cam comprising a cam body having first side and a second side, an edge, a bore extending through the cam body, a nose portion, a tooth extending from the cam body edge, and a post extending from one side, the cam adapted to rotate about a third pin passing through the cam bore, wherein the cam nose is adapted to selectively engage the latch tab and the cam tooth is adapted to selectively engage the release lever first arm portion. In exemplary embodiments, the latch assembly further comprises a trigger comprising a body having a first portion with a bore extending therethrough and a second portion having a detent portion, the trigger adapted to rotate about the third pin passing through the trigger bore, wherein the detent portion is adapted to selectively engage the release lever first arm portion. In exemplary embodiments, the latch assembly further comprises a solenoid associated with the housing, the solenoid including an actuation member and a piston, wherein the piston is adapted to selectively contact the release lever second arm portion. In exemplary embodiments, the housing and the latch cooperate to restrict movement of the striker latch-engaging when the latch assembly is in a locked position so as to maintain the door in a locked position and to permit disengagement of the striker latch-engaging section when the latch assembly is in an unlocked position.

In one exemplary embodiment, the present disclosure provides a locking apparatus for use with a movable object and a stationary object, the movable object including a striker member and a latch-engaging section, the locking apparatus comprising a latch assembly as described hereinabove. The housing and the latch cooperate to restrict movement of the striker latch-engaging when the latch assembly is in a locked position so as to maintain the movable object in a locked position with respect to the fixed object and to permit disengagement of the striker latch-engaging section when the latch assembly is in an unlocked position so as to permit movement of the movable object.

Other features will become apparent upon reading the following detailed description of certain exemplary embodiments, when taken in conjunction with the appended claims.

BRIEF DESCRIPTION OF THE DRAWINGS

The drawings disclose exemplary embodiments in which like reference characters designate the same or similar parts throughout the figures of which.

DETAILED DESCRIPTION

Figure 1:
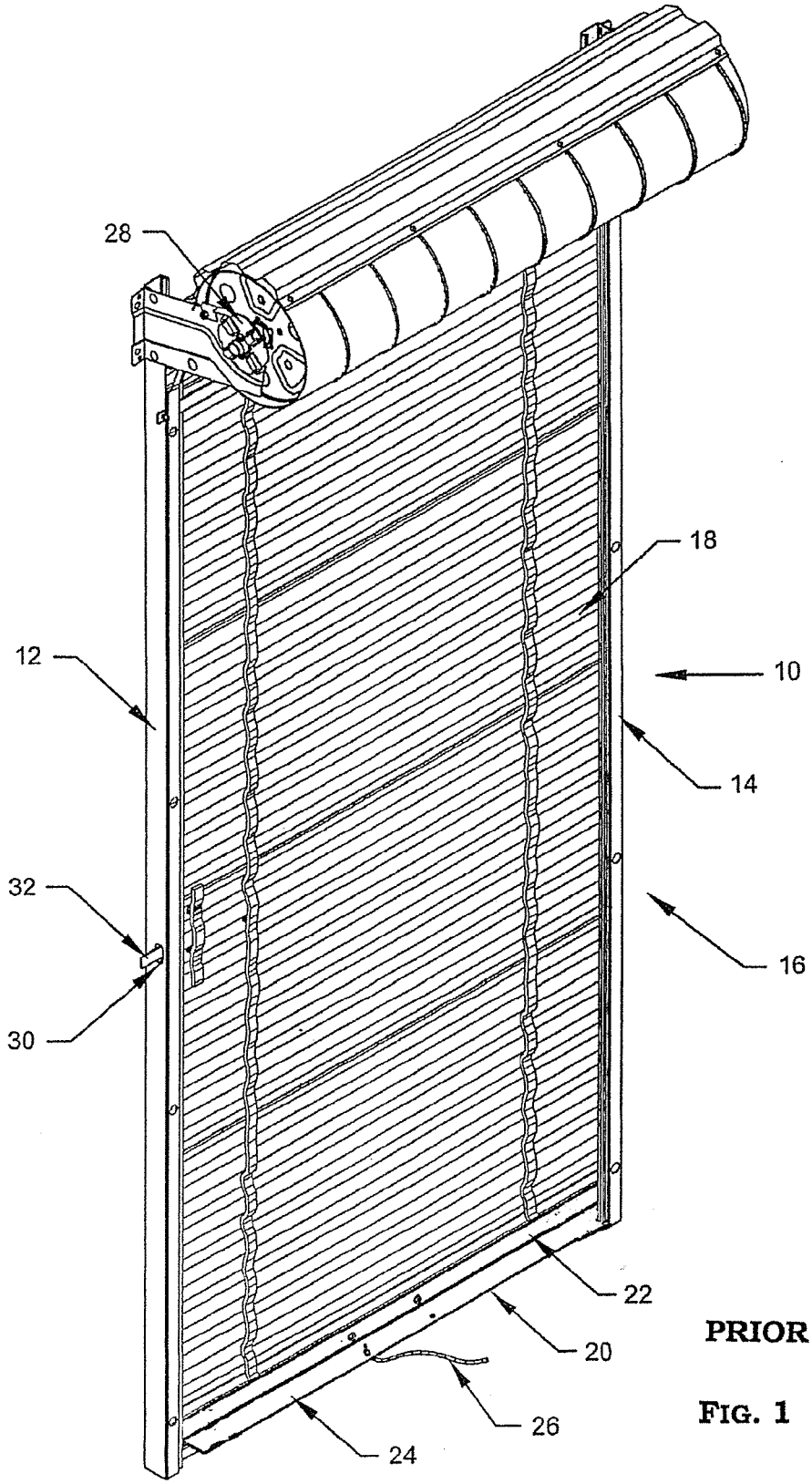
PRIOR ART FIG. 1
FIG. 1 (labeled "Prior Art") is a schematic perspective view of a conventional rollup door.

FIGS. 2-31 show various views and aspects of a first exemplary embodiment of a locking apparatus 50 for use with a door 16, such as a rollup door or other door system. It is to be understood that the locking apparatus 50 of the present disclosure can be used with doors other than rollup doors, such as, but not limited to, sectional doors, sliding doors, and the like, and can also be used or adapted for use in other environments which can benefit from a remote controlled locking and unlocking access system. Alternatively, the locking apparatus 50 can be used or adapted for use with lock and latch systems other than a door lock system. A rollup door will be discussed herein as one nonlimiting example. The door 16 includes a striker member 52. In exemplary embodiments, a locking apparatus 50 includes a latch assembly 54 and an electronic control assembly 300.

Figure 2:
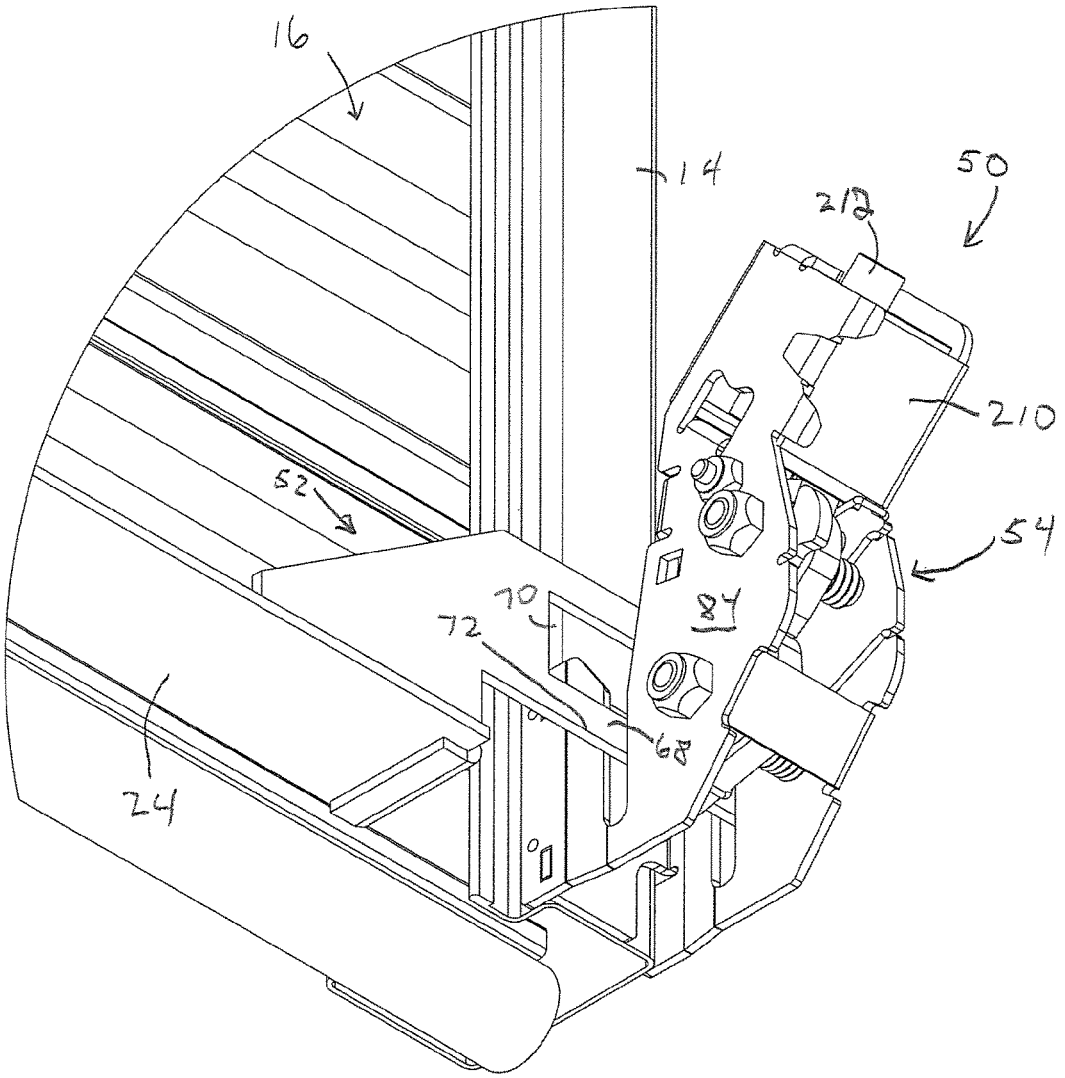
FIG. 2 is a perspective view of a first exemplary embodiment of a locking apparatus showing a first exemplary embodiment of a striker plate (mounted to a rollup door) engaged in a locked position with a first exemplary embodiment of a latch assembly.
Figure 3:
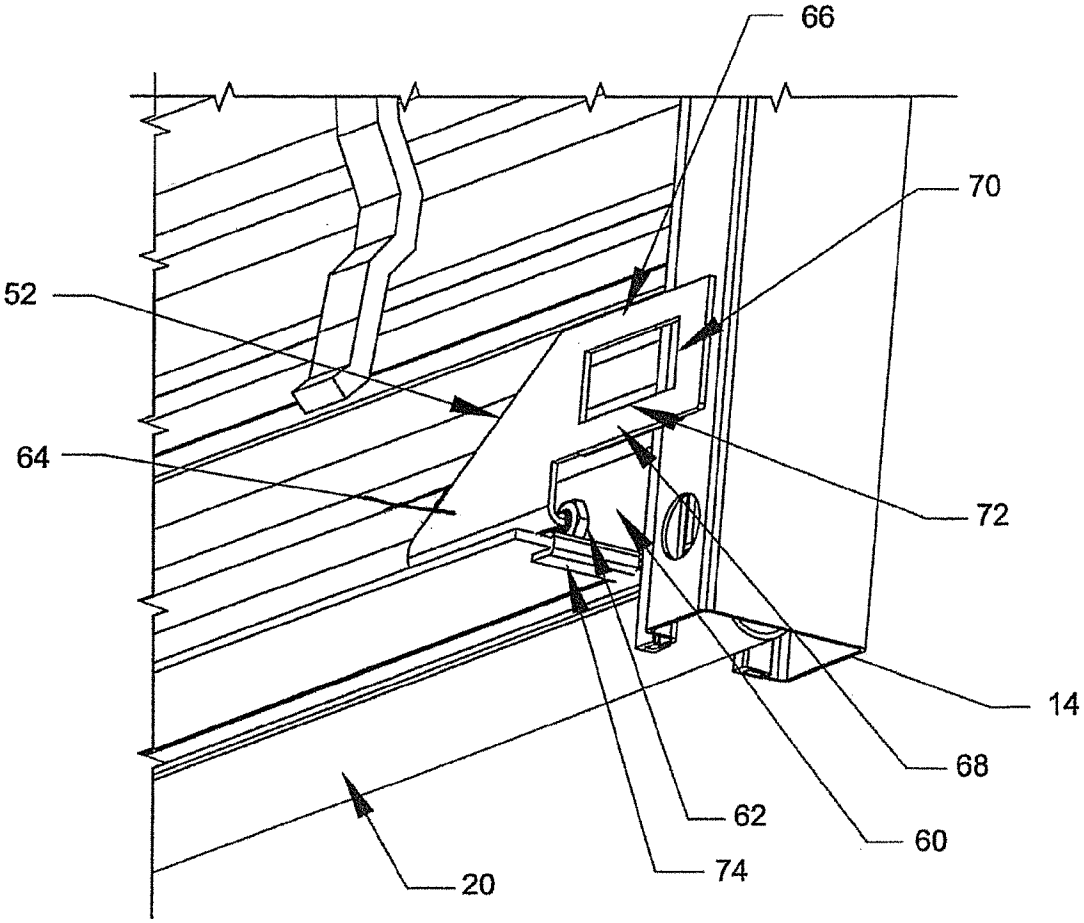
FIG. 3 is a perspective view of a detail showing the striker member according to one exemplary embodiment as attached to a rollup door.

FIG. 2 shows a perspective view of a first exemplary embodiment of a locking apparatus showing a first exemplary embodiment of a striker member 52 (mounted to a rollup door) engaged in a locked position with a first exemplary embodiment of a latch assembly 54. In exemplary embodiments, the striker member 52, shown in greater detail in FIG. 3, includes a mounting first portion 60 for attaching the striker member 52 to the door 16. The mounting portion 60 may have at least one hole 62 formed therein to permit mounting to the vertical section 22 of the door base member 20. Alternatively, the striker member 52 can be welded, adhered, or otherwise fixedly fastened to the door base member 20 or the area proximate thereto. The striker member 52 may further include a generally perpendicular second portion 64 which is generally parallel and proximate to the horizontal section of the door base member 20. The striker member 52 may further include a vertical third section 66 having a striker plate 68 extending therefrom, the striker plate having an opening 70 defined therein. The bottom edge portion 72 of the striker plate opening 70 optionally may be thicker than other portions of the striker member 52. In one exemplary embodiment, the second portion 64 optionally may have a generally U-shaped lip 74 which engages an end of the door base member horizontal section 24 to help maintain the striker member 52 in position.

The striker member 52 can be configured in different ways, as discussed further hereinbelow.

Figure 4:
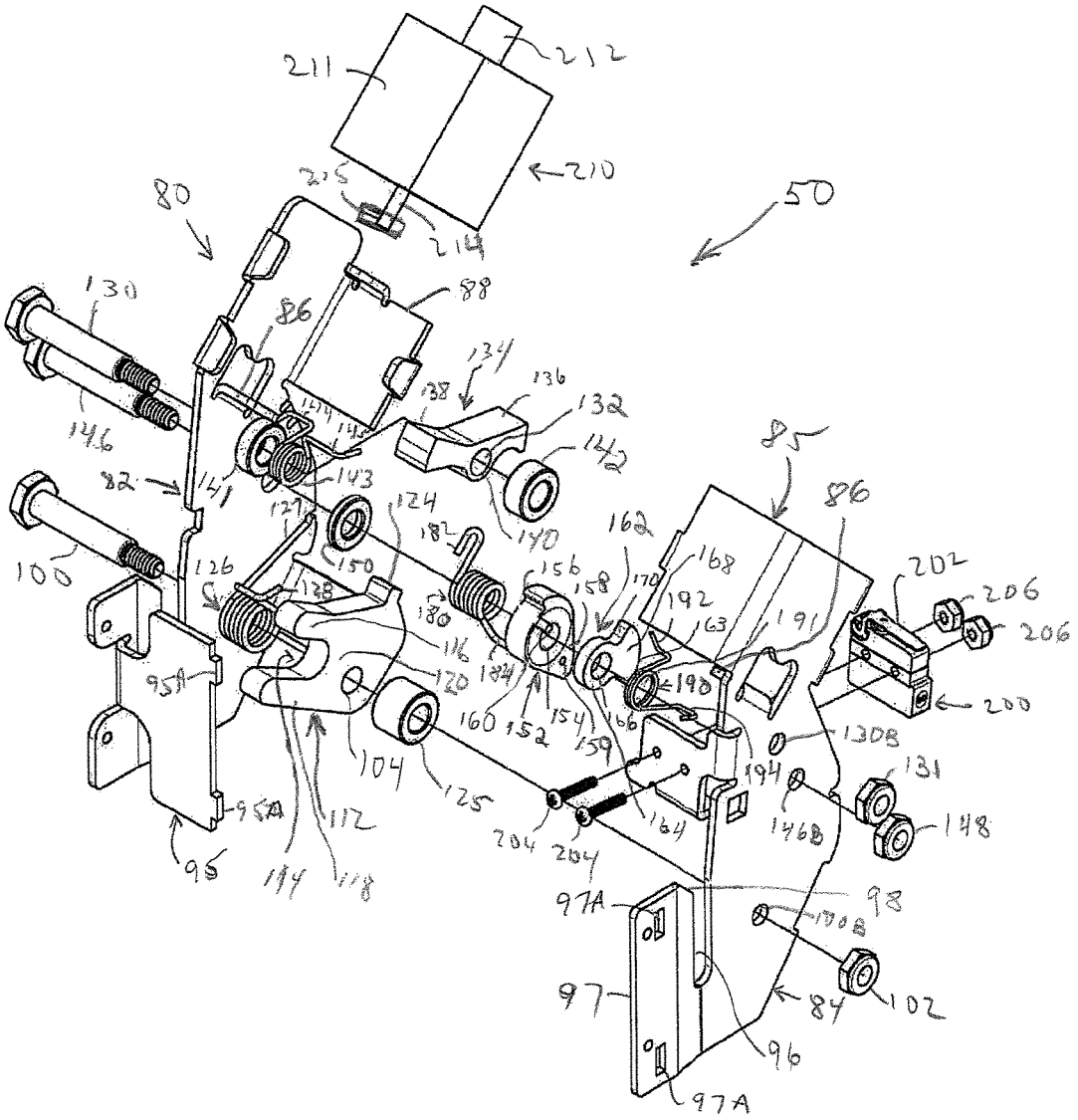
FIG. 4 is an exploded perspective view of a latch assembly according to one exemplary embodiment.

FIG. 4 shows an exploded view of one exemplary embodiment of a latch assembly 54 which includes include a housing 80 having opposing side members which, in exemplary embodiments, comprise a first side plate 82 and a second side plate 84. In exemplary embodiments, the housing may further comprise a receptacle 85 a base portion 86 and a rear portion 88 for holding a solenoid (discussed in detail hereinbelow). In exemplary embodiments, the side plates 82, 84 may be connected to each other, such as, but not limited to, by a first connecting plate 95 extending from the side plate 82 that connects with a second connecting plate 97 extending from side plate 84. In exemplary embodiments, the connecting plate 95 may have one or more tabs 95A that can be inserted in corresponding slots 97A in the second side plate 84. In exemplary embodiments, the first and second side plates 82, 84 each have an opening, recess, gap, or the like which can receive a portion of the striker plate 68 when in the engaged position. In exemplary embodiments, the opening is a slot 96. In exemplary embodiments, each slot 96 may have a generally I-shaped, J-shaped or U-shaped opening. In an alternative exemplary embodiment, only one or the other of the side plates 82, 84 has a recess.

By way of illustration, but not limitation, a slot 96 will be discussed as an exemplary embodiment of a recess in the side plate or plates 82, 84. It is to be understood that in such discussion, while each side plate 82, 84 is shown as having a slot 96, it is possible for only one side plate to have the slot 96. One feature of having a slot 96 in each side plate 82, 84 is that the striker plate 68 can be positioned so as to slide into either or both slots 96 from either side of the latch assembly 54. Each slot 96 may have an area 98 near the opening of the slot 96, such as a beveled edge area in each of the side plates 82, 84, that is slightly wider than the rest of the width of the slot 96 to facilitate insertion of the striker plate 68. From a functional perspective, any shape for the slot 96 may be utilized that enables the striker plate 68 to be retained in the general area of the housing 80 with minimal horizontal movement (i.e., perpendicular to the vertical slots 96) when the striker plate 68 is in the locked position (as described in further detail hereinbelow). The housing 80 has an opening 99 formed therein bounded, in general, by the side plates 82, 84 and the connecting plate 95. In exemplary embodiments, it is into this opening 99 that at least a portion of the striker plate 68 can be inserted (and, in exemplary embodiments, further inserted into the slots 96).

Figure 5:
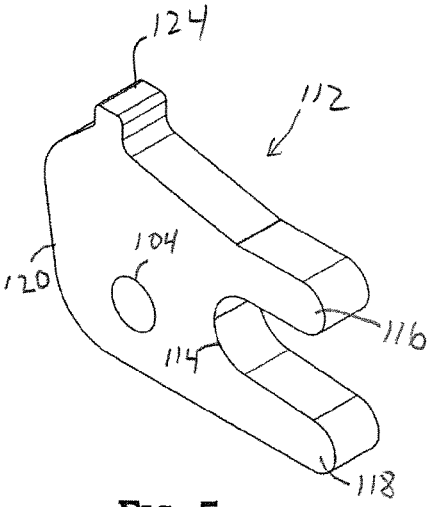
FIG. 5 is perspective view of one exemplary embodiment of a latch.

A first pin 100 is mounted between the two side plates 82, 84 and passes through apertures 100A (not shown), 100B in the side plates 82, 84, respectively. In exemplary embodiments, the first pin 100 may be a bolt, partially threaded screw, cotter pin or other structure that provides an axle-like support for rotation of one or more components associated with the pin. In exemplary embodiments, the first pin 100 may be a bolt having at least a portion of its distal end being threaded. A mating threaded nut 102 can secure the first pin 100 between the side plates 82, 84. The first pin 100 passes through a bore 104 in a latch 112. In exemplary embodiments, the latch 112 (a detail view of which is shown in FIG. 5) has a generally U-shaped opening 114 formed by a first leg 116 and a second leg 118 extending from a middle portion 120, the middle portion 120 having the bore 104 to receive the first pin 100. The middle portion 120 has a tab 124 extending from an edge. In exemplary embodiments, the first leg 116 may be shorter than the second leg 118. In exemplary embodiments, a spacer 125 may be fitted over the first pin 100. A first spring 126 fits over the first pin 100 and has a first end 127 and second end 128. The first end 127 abuts the first side plate 82 and the second end 128 abuts the latch 112.

Figure 6:
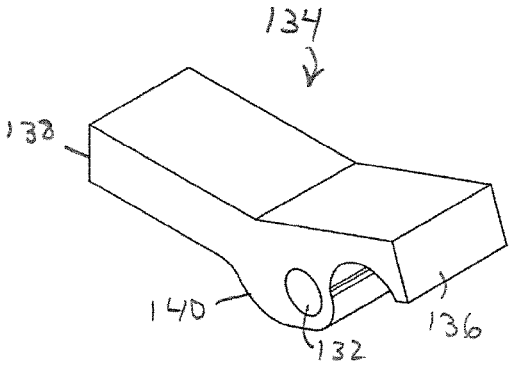
FIG. 6 is perspective view of one exemplary embodiment of a release lever.

A second pin 130, generally similar in construction options to the first pin 100 is mounted between the two side plates 82, 84 by means of aperture 130A (not shown), 130B in the side plates 82, 84, respectively, and maintained by a nut 131. In one exemplary embodiment of a locking apparatus 50 having a manual release feature, a release lever 134 (a detail view of which is shown in FIG. 6) comprises a first portion comprising a manual release arm 136, a second portion comprising a stop arm 138, and a middle portion 140 having a bore 132 extending therethrough. The second pin 130 passes through the bore 132. In exemplary embodiments, a spacer 141 proximate to the side plate 82 is fitted over the second pin 130. In exemplary embodiments, a spacer 142 proximate to the side plate 84 is fitted over the second pin 130. The second pin 130 passes through a second spring 143, which has a first end 144 and a second end 145. The first end 144 is associated with the first side plate 82 and the second end 145 is associated with the release lever 134.

Figure 7:
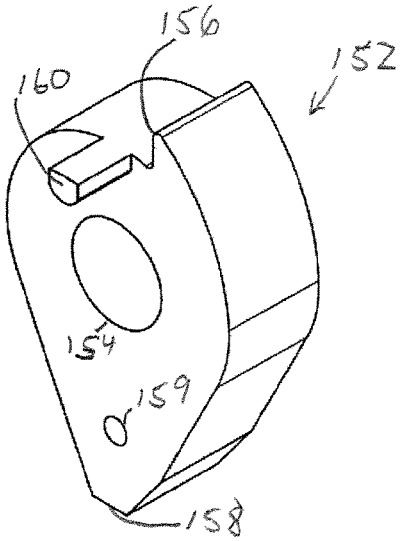
FIG. 7 is perspective view of one exemplary embodiment of a cam.
Figure 8:
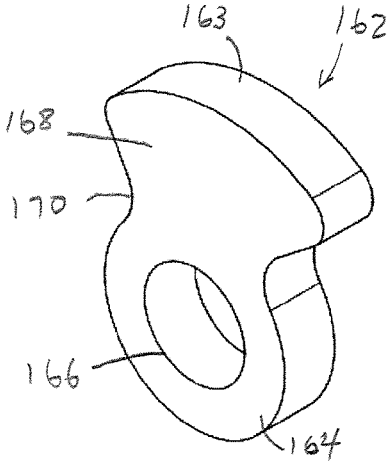
FIG. 8 is perspective view of one exemplary embodiment of a trigger.

A third pin 146, generally similar in construction options to the first pin 100, is mounted between the side plates 82, 84 via an aperture 146A (not shown), 146B in each side plate 82, 84, respectively, and maintained by a nut 148. Optionally, a spacer 150 is fitted over the third pin 146. A cam 152 (a detail view of which is shown in FIG. 7) has a bore 154 through which the third pin 146 passes. The cam 152 has a tooth 156 protruding from the edge and a nose portion 158, which may be generally opposite the tooth 156. The nose portion 158 may have an aperture 159 extending at least partially therethrough. A post 160 extends from one face of the cam 152 (generally parallel to the axis of the bore 154) proximate to the tooth 156. A trigger 162 (a detail view of which is shown in FIG. 8) has a curved edge 163 and has a first portion 164 having a bore 166 through which the third pin 146 passes. The trigger 162 also has a trigger body portion 168 that is flared, creating a detent portion 170.

A cam spring 180 is fitted over the third pin 146. The cam spring 180 has a first end 182 and a second end 184. The first end 182 is associated with the first side plate 82 and the second end 184 is associated with the cam aperture 159. A trigger spring 190 having an opening 191 is fitted over the third pin 146. The trigger spring 190 has a first end 192 and a second end 194. The first end 192 is associated with the trigger 162 and the second end 194 is associated with the second plate 84. Locking rotation of the cam 152 forces the trigger 162 rotation away from the release arm 134 by means of the cam post 160 contact with the trigger detent 170, which allows the release arm 134 to return to starting/locked position where the cam 152 and the trigger 162 are held in place via the cam tooth 156 and the trigger detent 170.

In exemplary embodiments, a limit switch 200 may be attached to the housing 80, as shown in FIG. 4. The limit switch has a contact arm 202 that can be contacted by the release lever 134. The limit switch 200 is in electronic communication with a control assembly 300 (described in greater detail hereinbelow). The limit switch 200 can detect when the latch 112 has been rotated and whether the latch assembly 54 is in the locked or unlocked state. Alternatively, instead of a limit switch, an optical, motion detection or other type of sensor known to those skilled in the art can be utilized.

A solenoid 210 may be mounted to or otherwise associated with the housing 80. The solenoid 210 may include a housing 211 and has a push button 212 and a piston 214. The solenoid 210 includes an actuator that receives an electronic actuation signal from the control assembly 300.

Figure 9A:
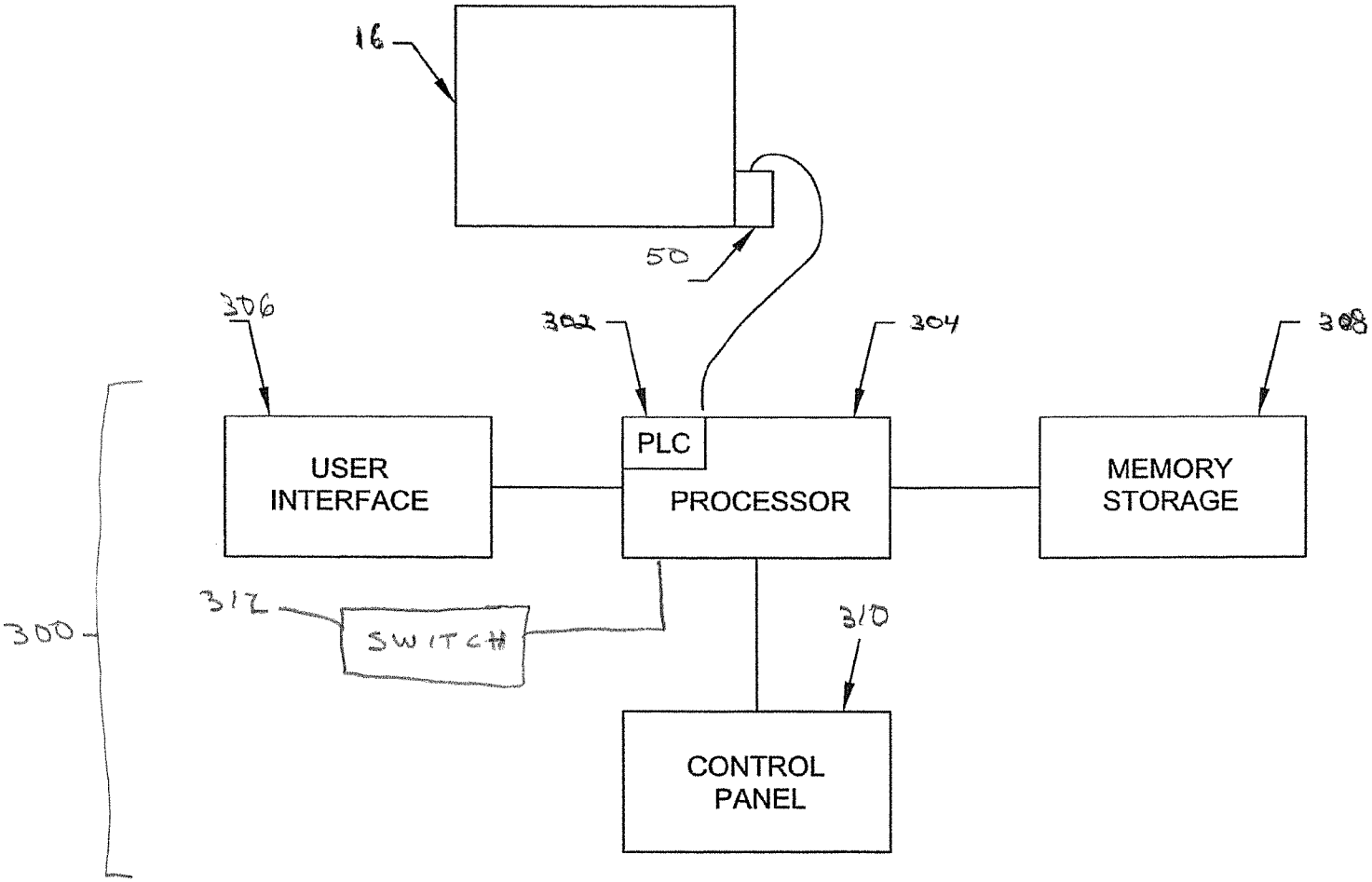
FIG. 9A is a schematic view of one exemplary embodiment of a control assembly.

In exemplary embodiments, the locking apparatus 50 further includes a control assembly 300, as shown in FIG. 9A, which has a programmable logic controller ("PLC") 302, as part of a processor 304 and logic board, which is in electronic communication with the limit switch 200. The control assembly 300 may include an user interface 306 (such as, but not limited to, a keypad, key/lock, magnetic or optical card reader, bar code reader, keypad, radio frequency identification tag, fingerprint, eye or other biometric scanner, voice recognition device, combinations of the foregoing and the like), and a facility manager accessible control interface. The control assembly 300 may also include memory storage 308 for storing and retrieving user access identification information and for managing access and generating reports. A facility manager or other authorized user may access the processor 304 via a control panel 310.

The limit switch 200 is positioned beneath the stop arm 138 portion of the release lever 134. When the piston 214 is extended it contacts the stop arm 138 forcing the release lever 134 to rotate. In this position, the arm 138 depresses the limit switch arm 212 causing a signal to be transmitted indicating an unlocked condition of the locking apparatus 50. It is to be understood that a different mechanism can be used instead of a limit switch to detect and/or transmit locked/unlocked condition information.

In exemplary embodiments, a locking apparatus 50 generally comprises the main components of a striker member 52, a release lever 134, a cam 152, a trigger 162, a latch 112, a solenoid 210. The locking apparatus 50 may also include a limit switch 200. The release lever 134, cam 152, trigger 162 and latch 112 each have a torsional spring associated therewith (springs 143, 180, 190 and 126, respectively) which bias rotational movement of each of these four components in one direction. When the latch assembly 54 is in a locked position (as shown in FIGS. 10-13 (perspective views) and FIGS. 14-16 (partial cutaway views)) the striker plate 68 is held in the slot 96 and removal is prevented. The position of activation is the locked position where the solenoid piston 214 is in the retracted position (i.e., extending relatively less outside of the solenoid housing 211 than in the extended position). piston 214 The cam 152 is held in place by the release lever 134 release arm 136 contacting the tooth 156. The trigger 162 is also maintained in place by the release lever arm 136 by means of the detent 170 portion of the trigger body 168. The latch 112 is maintained in the locked position (i.e., engaging the striker plate 68) by the nose portion 158 of the cam 152.

In exemplary embodiments, the latch assembly 54 can be mounted to one of the vertical guide tracks 12 or 14, or proximate thereto (see FIG. 2). FIGS. 17-22 show views of one exemplary embodiment of a latch assembly 54 in an unlocked position. In the unlocked position, the striker plate 68 (shown only in selected views to avoid obstructing viewing of other parts) is positioned above the latch assembly 54 as the door 16 is lowered. In the unlocked position, the solenoid piston 214 is in an extended position (see FIG. 18). The trigger latch second leg 118 is shown angled upward as biased by the first spring 126 so that the U-shaped opening 114 is angled upward and so that the striker plate 68 can enter the opening 99, the opening 114 and the slots 96. Overall, in exemplary embodiments, in the unlocked position the release lever 134 does not engage the cam 152 (see FIGS. 21, 25 and 26). The release lever arm 136 rests on the trigger 162 curved edge 163 (see FIG. 21) until the latch 112 rotation (locking) forces rotation of the cam 152.

To lock the striker plate 68 in the latch assembly 54, the rollup door 16 is lowered and the striker plate 68 slides into the slots 96, as shown in FIGS. 10-16. The bottom edge 72 of the striker plate 68 contacts the second leg 118 of the latch 112, causing the latch 112 to rotate against the spring 126 bias so that the first leg 116 prevents the striker plate 68 from traveling up and out of the slots 96 (see FIG. 16). As the latch 112 rotates (counterclockwise as viewed in FIGS. 14 and 21), the tab 124 contacts the nose 158 of the cam 152, forcing clockwise rotation of the cam 152 against the spring 180 bias and holding the latch 112 in a locked position with the nose portion 158. As shown in FIGS. 22-31, clockwise cam 152 rotation causes the cam post 160 to contact the trigger 162 at the detent 170, forcing clockwise rotation of the trigger 162 against the torsion spring (180)-biased rotation, thus allowing the release arm 136 to release, rotate counterclockwise and snap into place behind the tooth 156 of the cam 152. In this locked position the release lever stop arm 138 does not contact the limit switch contact arm 202. This consequently forces the piston 214 at least partially back into the solenoid 210 and results in locking of the latch assembly 54. The latch assembly 54 acts to maintain the striker plate 68 in a locked position such that the striker plate 68 is vertically restricted in the opening 114 and horizontally restricted in the slots 96.

Figure 23:
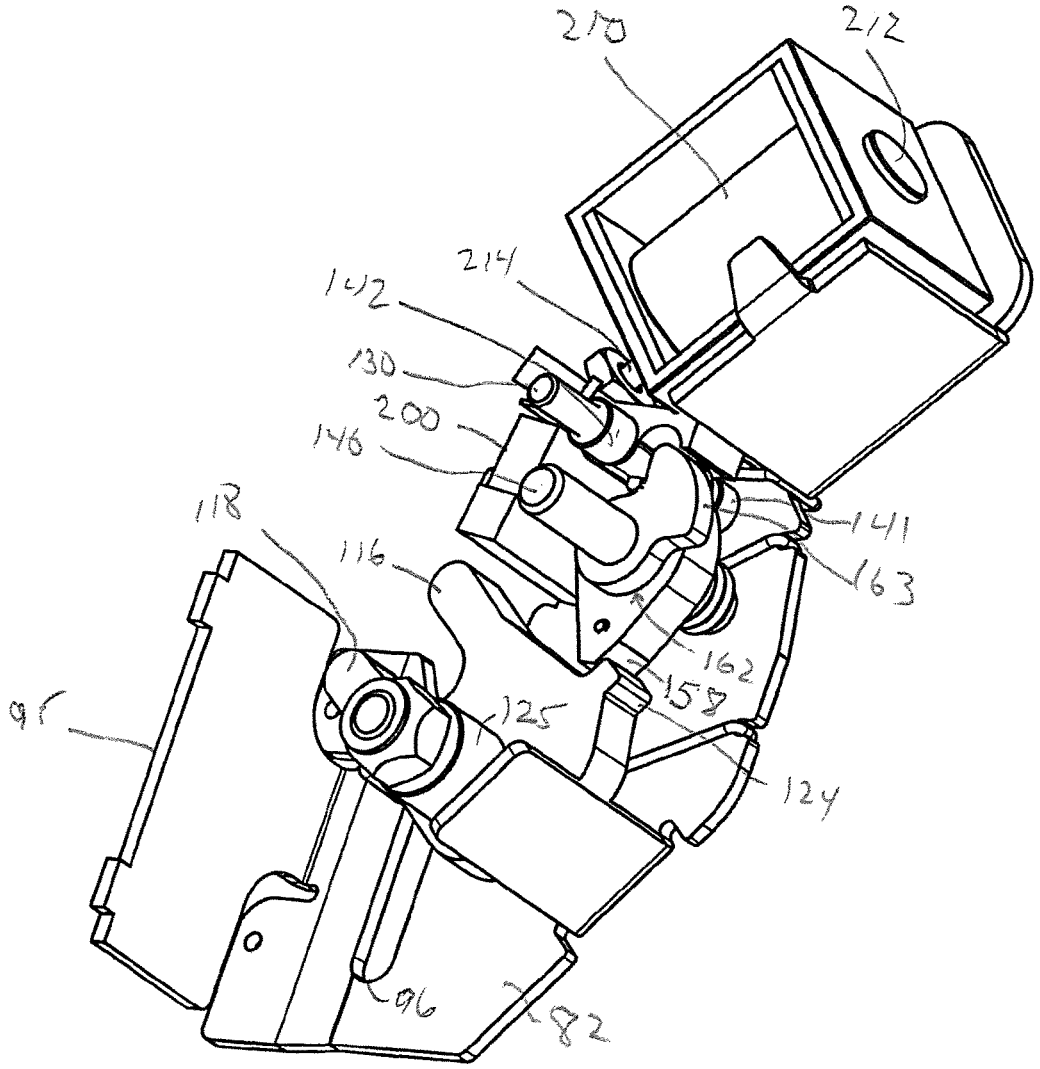
FIG. 23 is another perspective view in partial cutaway showing the latch assembly of FIG. 2 in an unlocked position and the release arm engaged with the trigger.
Figure 24:
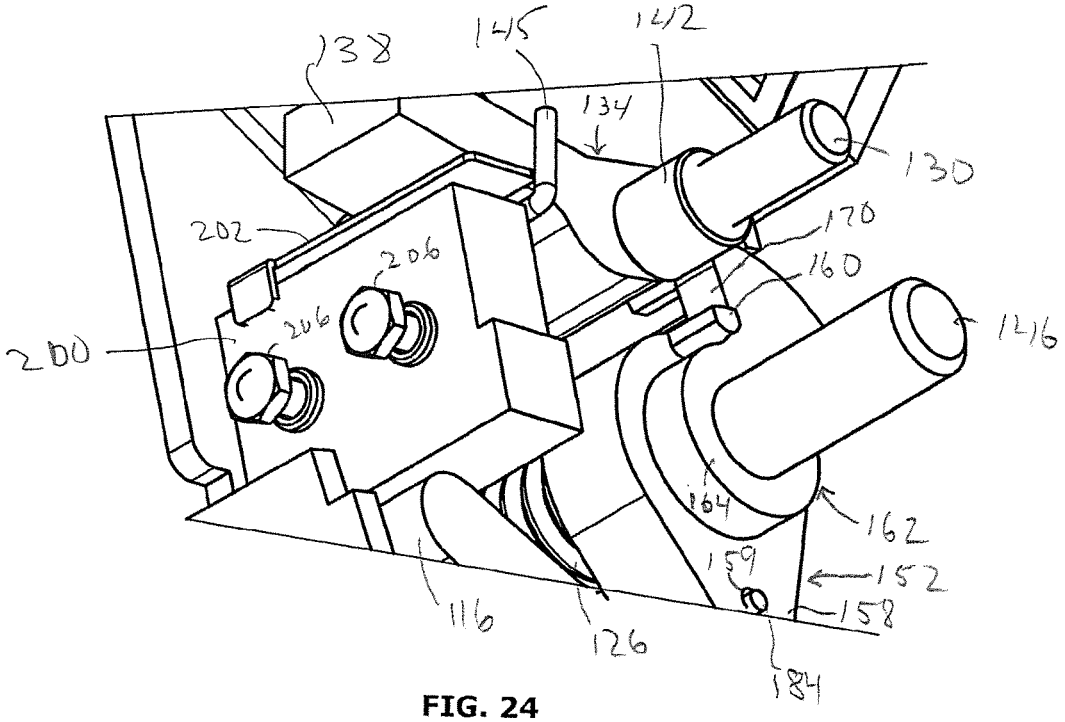
FIG. 24 is a schematic view of a detail of the limit switch, release lever, cam and trigger showing the release lever engaged with the trigger and the cam post engaged with the trigger detent.
Figure 25:
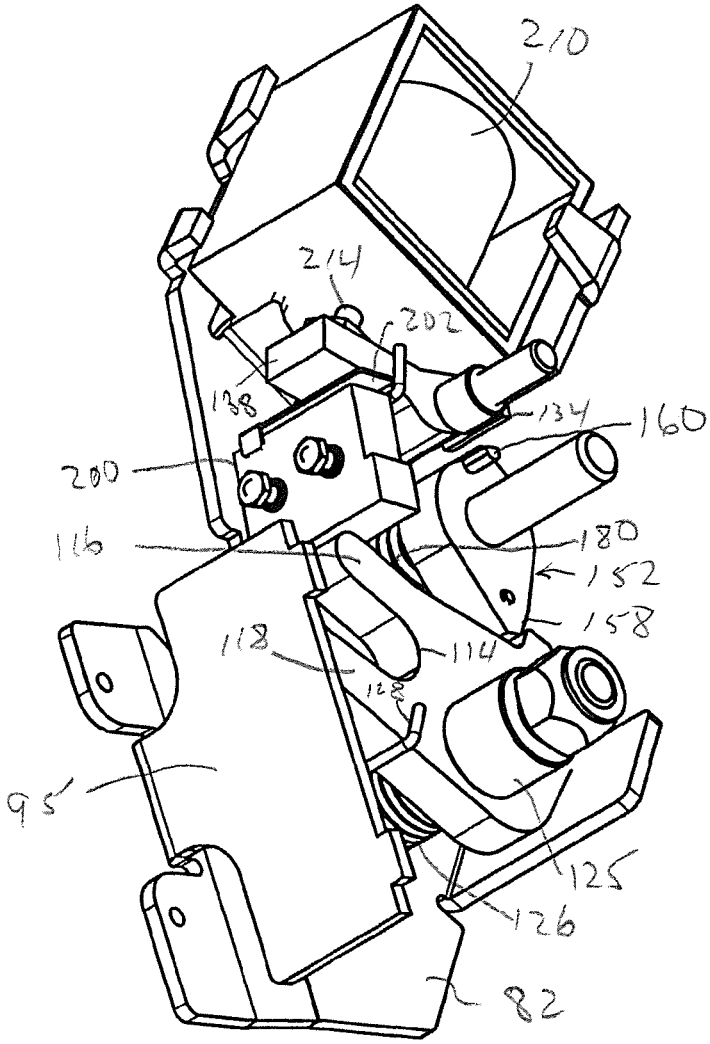
FIG. 25 is a right-front perspective view in partial cutaway showing the latch assembly of FIG. 2 in an unlocked position showing the release lever disengaged from the cam tooth and the release lever contacting the limit switch contact arm.
Figure 26:
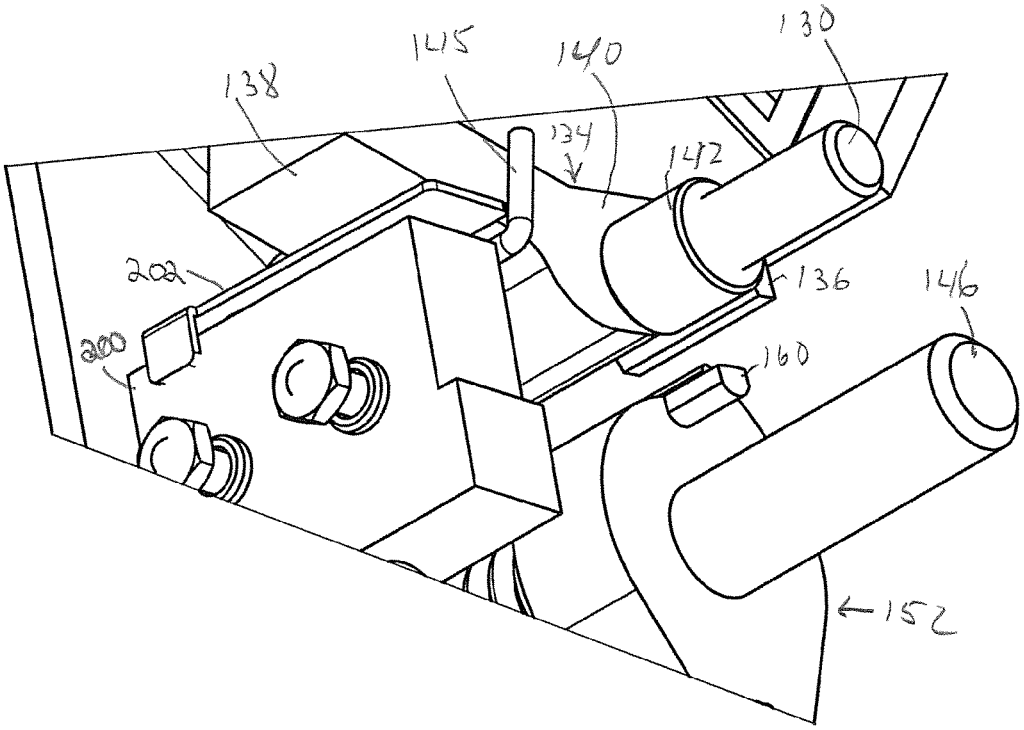
FIG. 26 is a schematic view of a detail of the limit switch, release lever and cam showing the release lever disengaged from the cam tooth.
Figure 27:
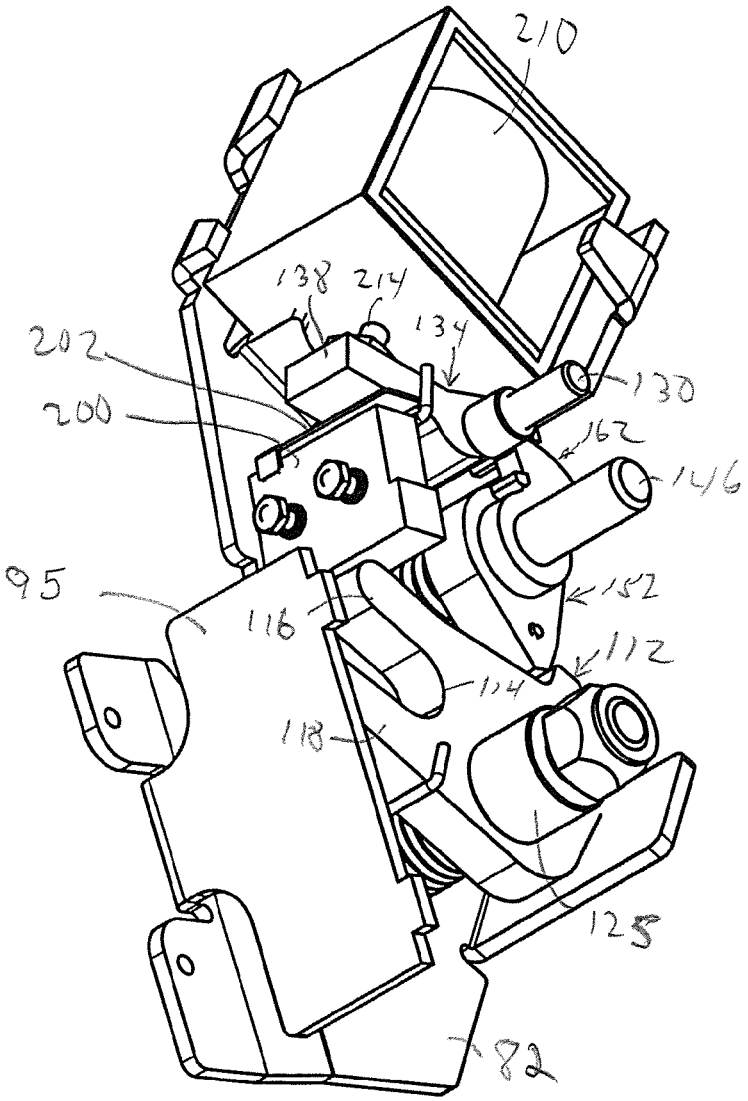
FIG. 27 is a right-front perspective view in partial cutaway showing the latch assembly of FIG. 2 in an unlocked position showing the release lever disengaged from the cam tooth.
Figure 28:
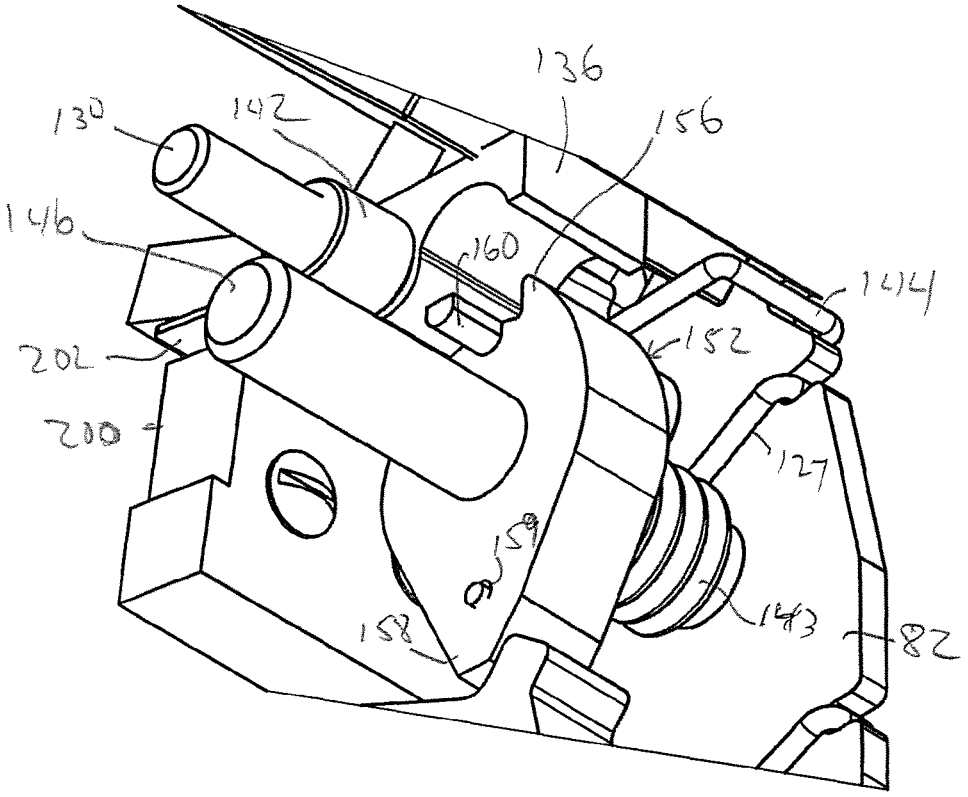
FIG. 28 is a schematic view of a detail of the release lever and cam showing the cam and latch tab.
Figure 29:
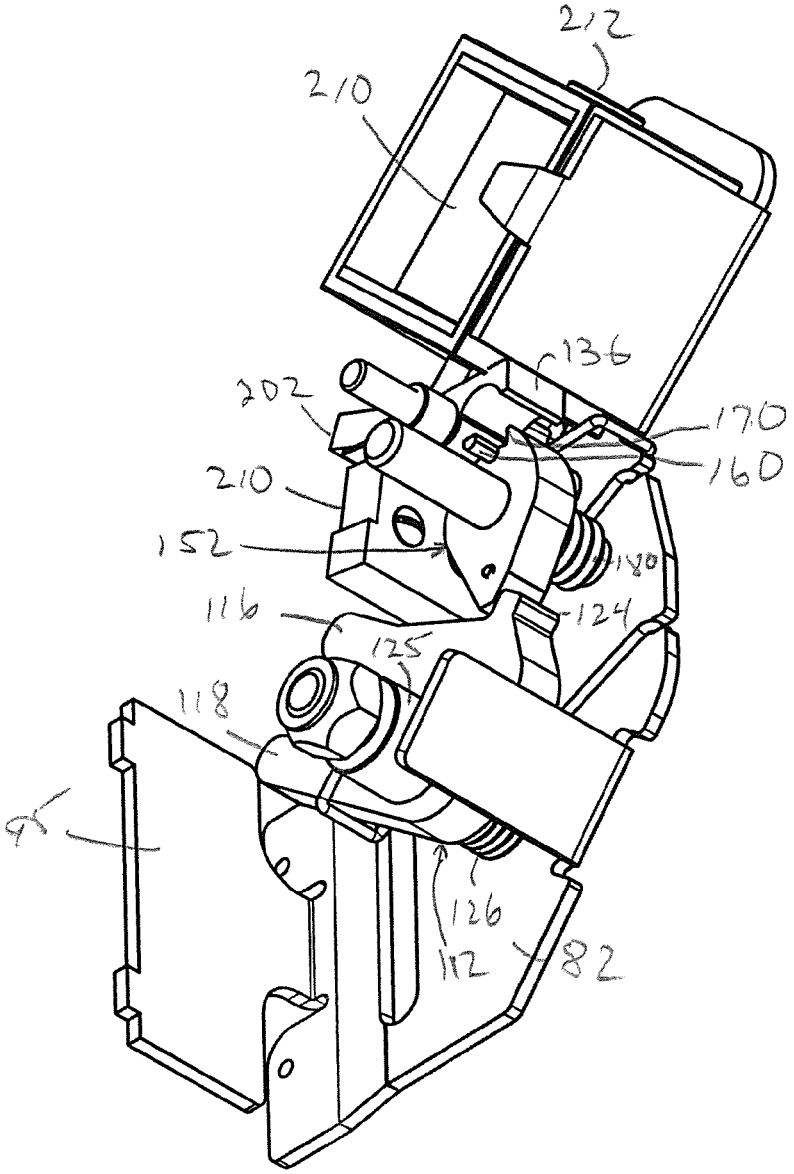
FIG. 29 is a left-front perspective view in partial cutaway showing the latch assembly of FIG. 2 in an unlocked position showing the release lever disengaged from the cam tooth.
Figure 30:
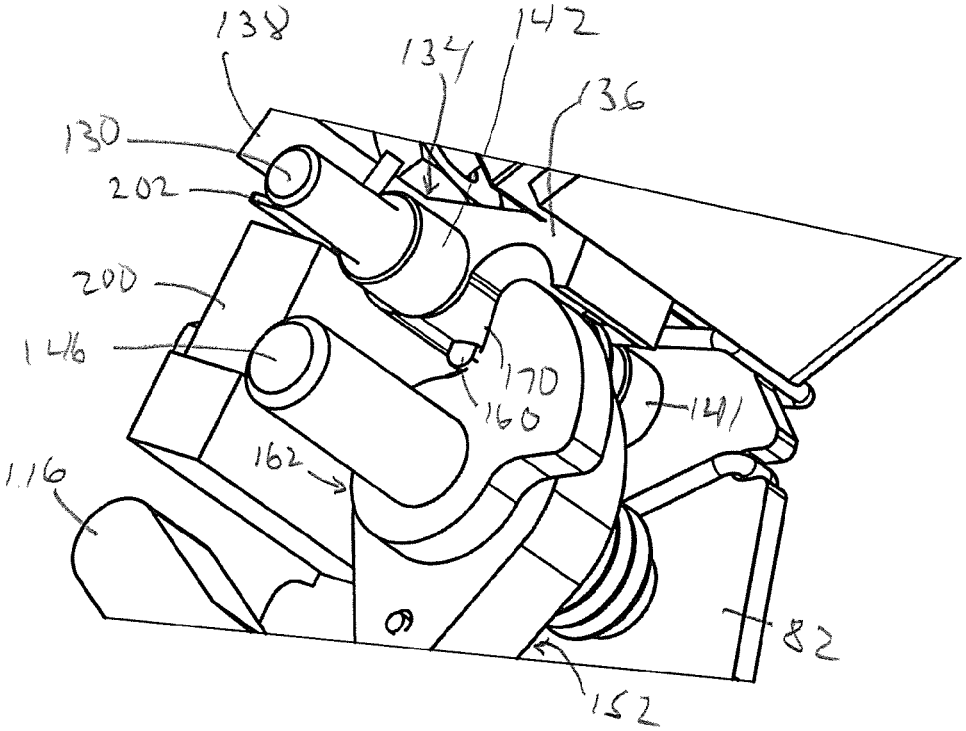
FIG. 30 is a schematic view of a detail of the release lever and cam showing the trigger and cam.
Figure 31:
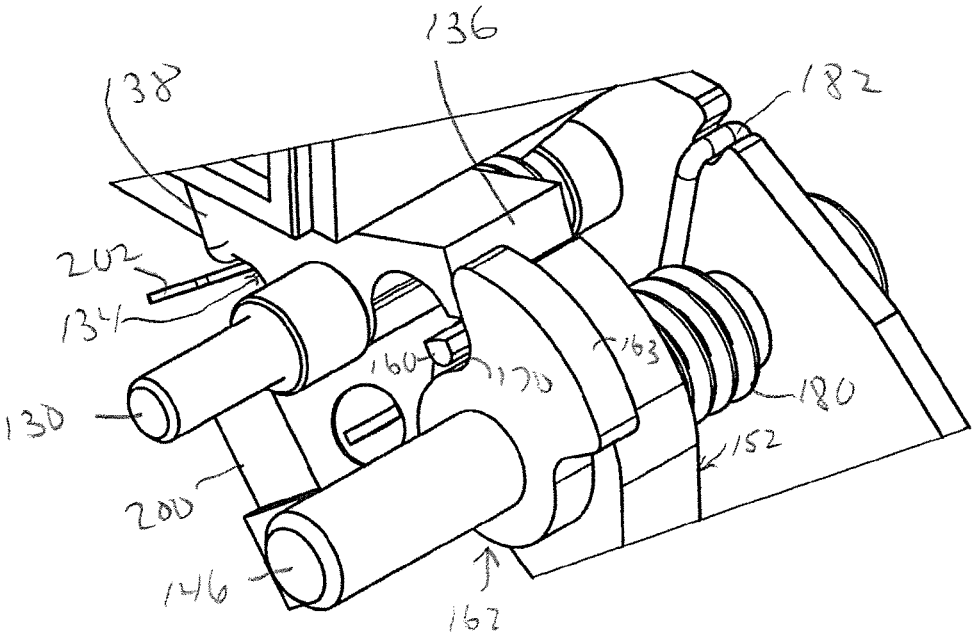
FIG. 31 is another schematic view of a detail of the release lever and cam showing the trigger and cam.

To unlock the latch assembly 54 from the locked position and release the striker plate 68, the solenoid 210 is activated manually (by depressing the button 212) or electronically, causing the piston 214 to extend. The extension of the piston 214 causes release lever 134 to rotate about the pin 130 against the torsion spring (143)-biased rotation force, causing the stop arm 138 to pivot downward and the release arm 136 to pivot upward (as shown in FIGS. 23-24). The release arm 136 then disengages from the cam tooth 156. The cam 152 rotates and the nose portion 158 disengages from the latch 112 tab 124. The latch 112 rotates to permit the striker plate 68 to slide out of the slot 96 and the door 16 raised. FIG. 26 illustrates the cam 152 and post 160 (with the trigger 162 not shown). In this position, the cam 152 does not contact the release lever 134. The release lever 134 is maintained in this position by the trigger 162 (not shown in FIG. 26). The limit switch 200 can detect the movement of the latch 112. The stop arm 138 contacts the limit switch contact arm 202 which opens or closes electrical circuit and prompts the control assembly 300 to indicate that the door 16 is locked or unlocked in the locking apparatus 50.

Figure 9B:
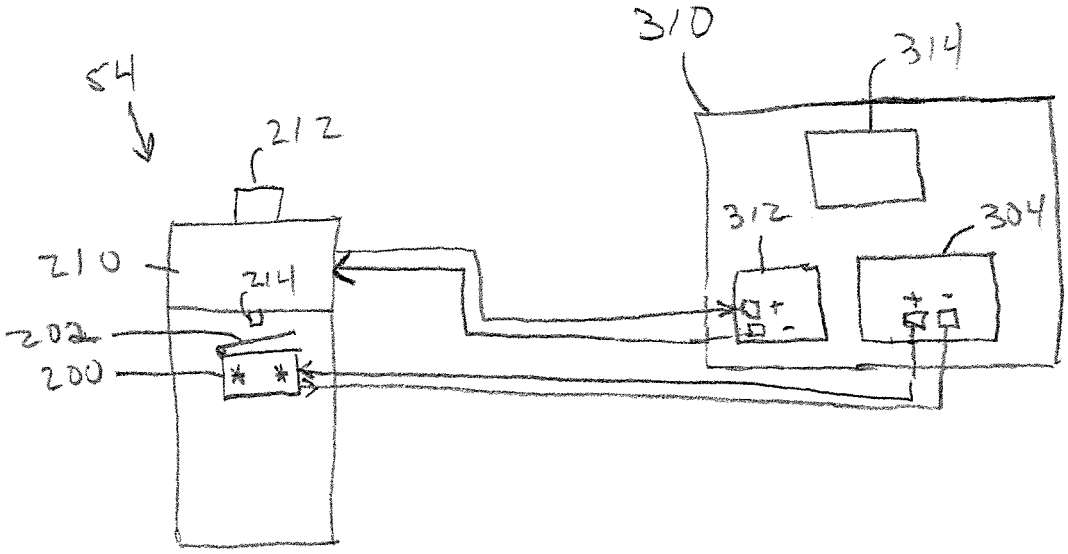
FIG. 9B is a schematic flow diagram showing electrical current flow according to one exemplary embodiment.
Figure 10:
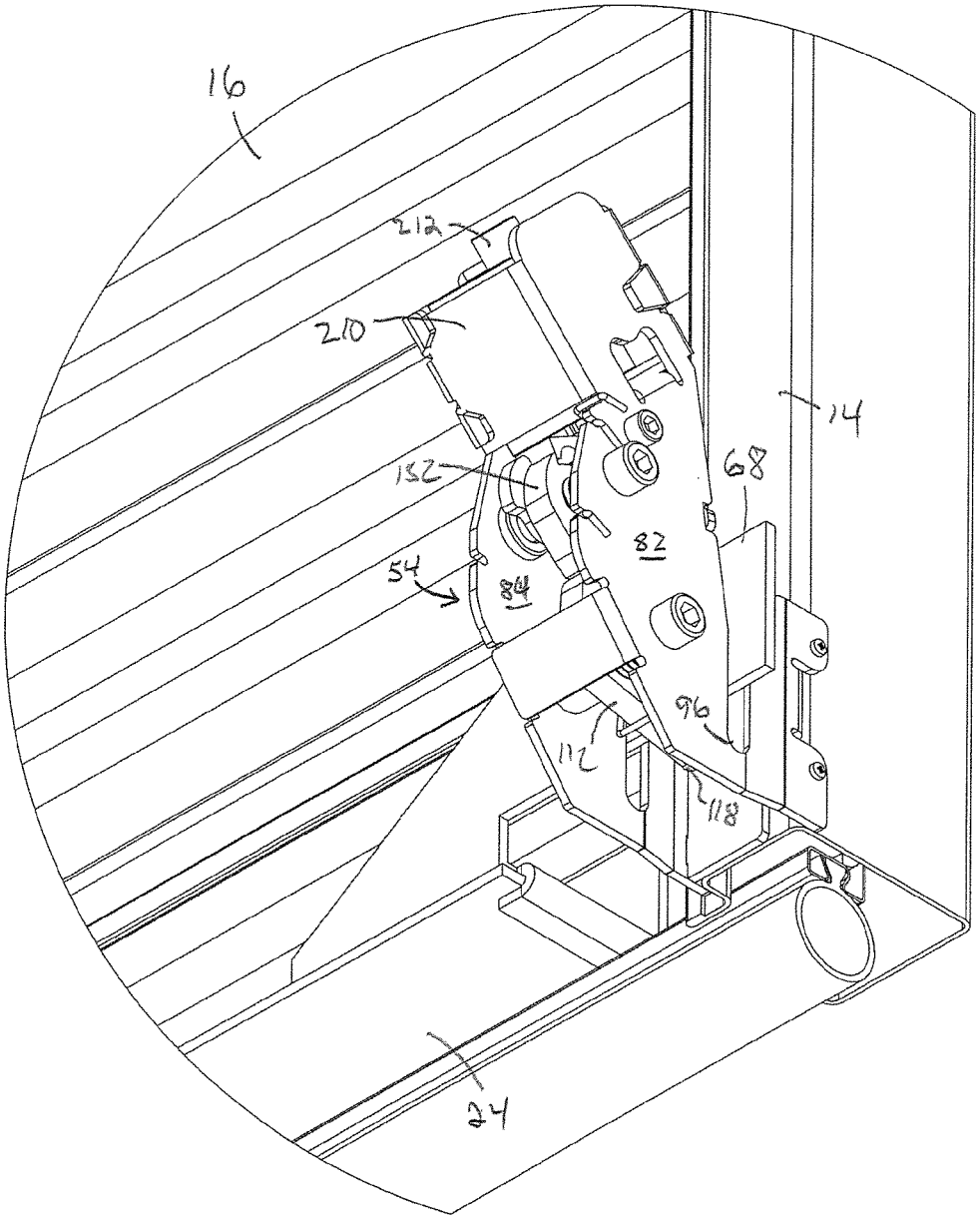
FIG. 10 is bottom-side perspective view of the locking apparatus of FIG. 2 showing a striker member shown in a locked position with a latch assembly.
Figure 11:
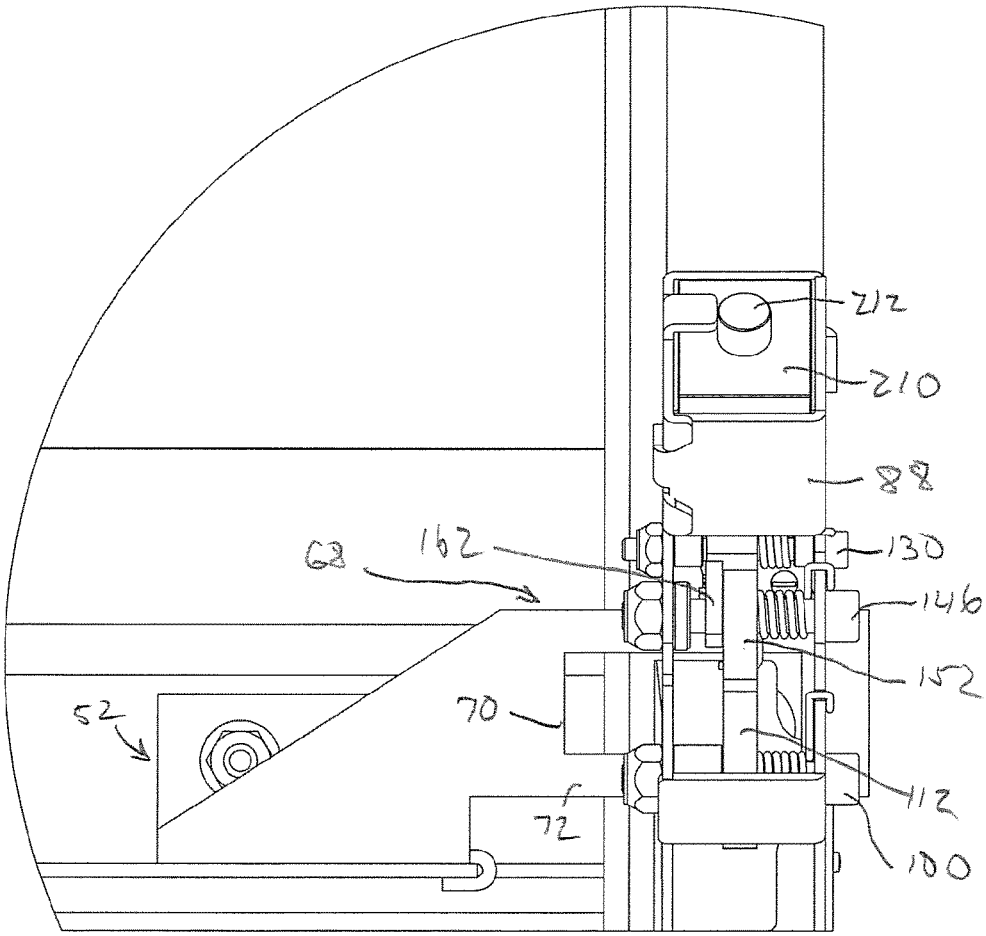
FIG. 11 is front elevational view of the locking apparatus of FIG. 2 showing a striker member shown in a locked position with a latch assembly.
Figure 12:
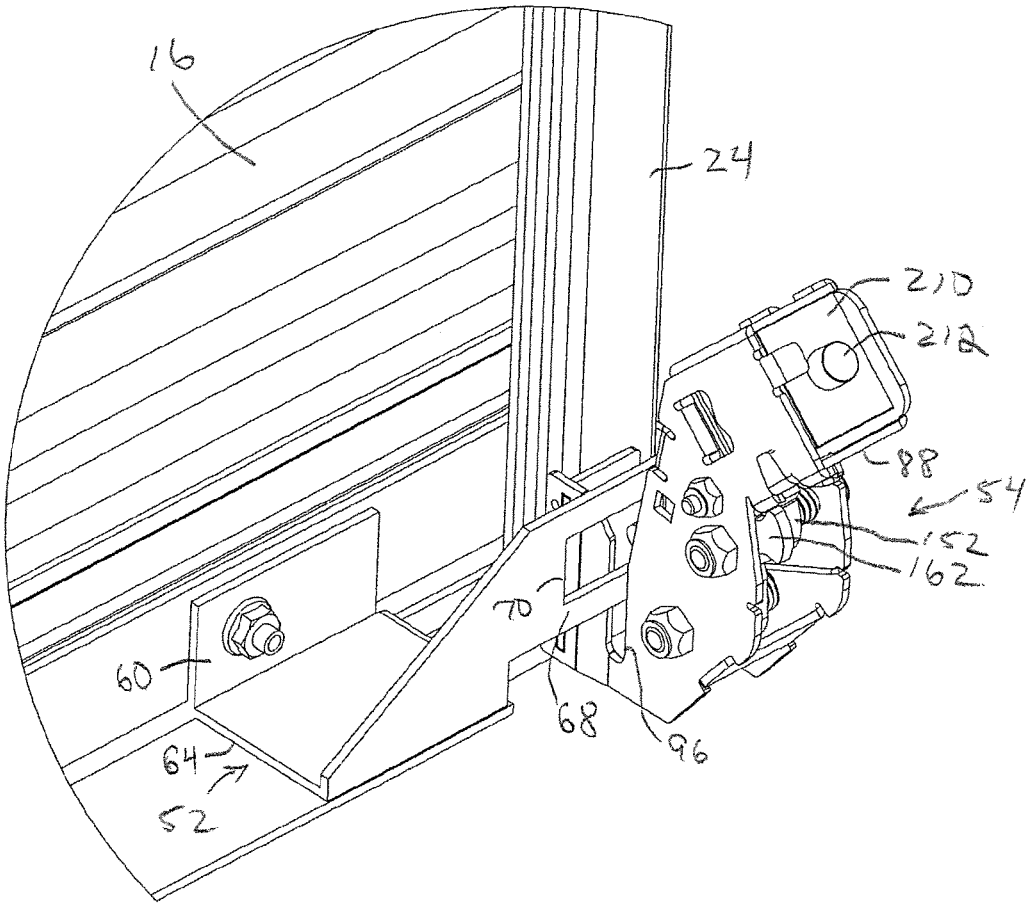
FIG. 12 is a perspective view of the locking apparatus of FIG. 2 showing a striker member shown in a locked position with a latch assembly.
Figure 13:
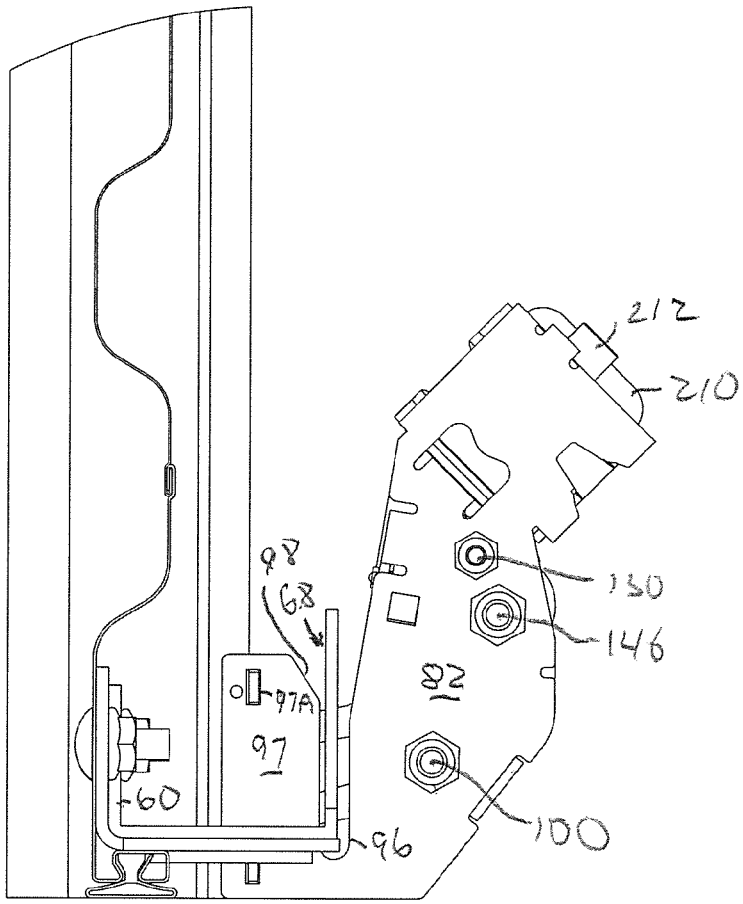
FIG. 13 is a side elevational view of the locking apparatus of FIG. 2 showing a striker member shown in a locked position with a latch assembly.
Figure 14:
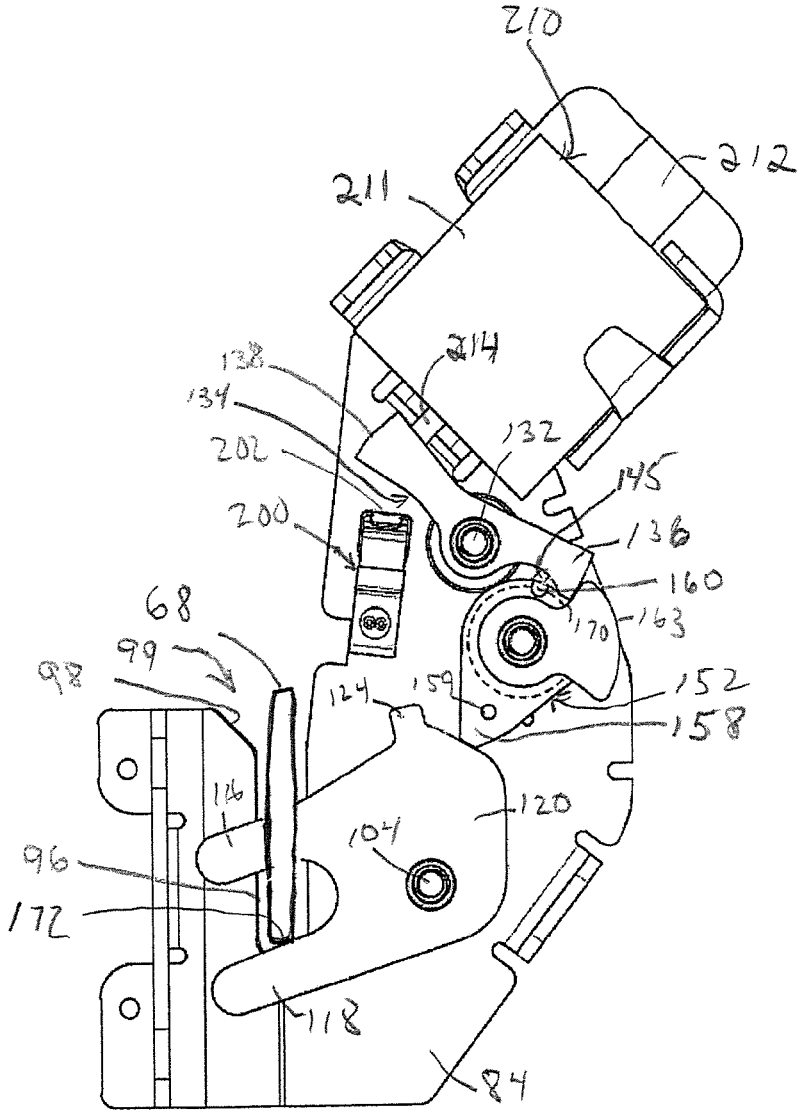
FIG. 14 is a side elevational view in partial cutaway showing the latch assembly of FIG. 2 a locked position.
Figure 15:
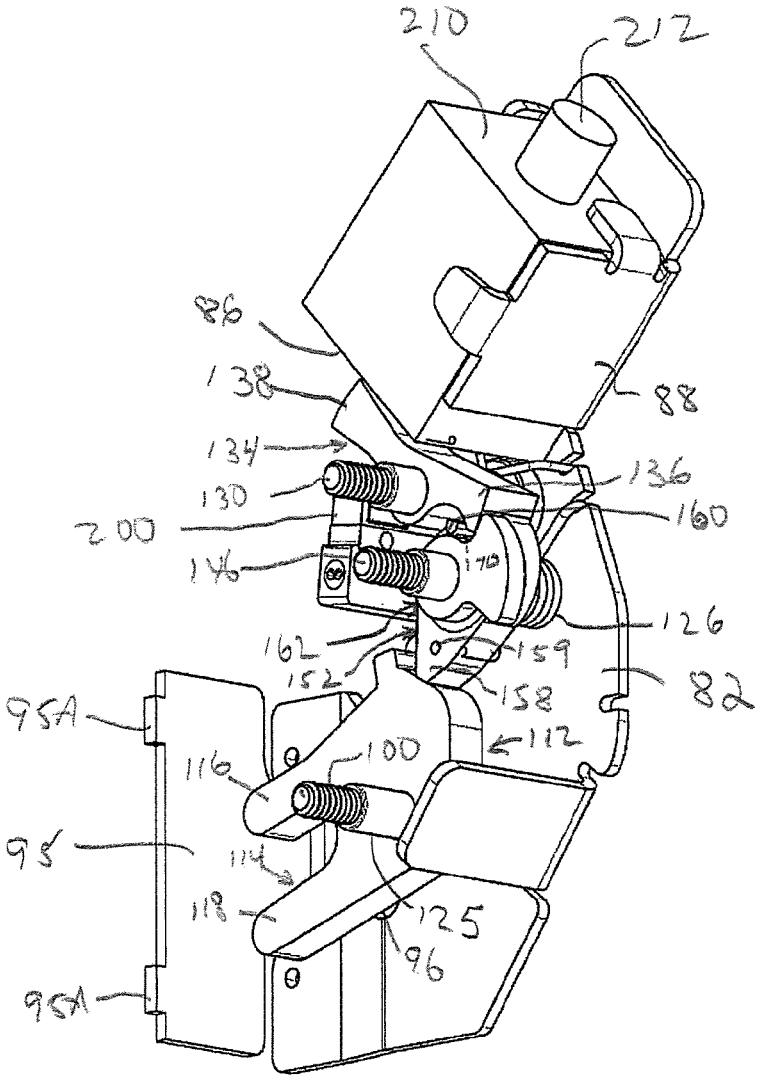
FIG. 15 is a left side perspective view in partial cutaway showing the latch assembly of FIG. 2 a locked position.
Figure 16:
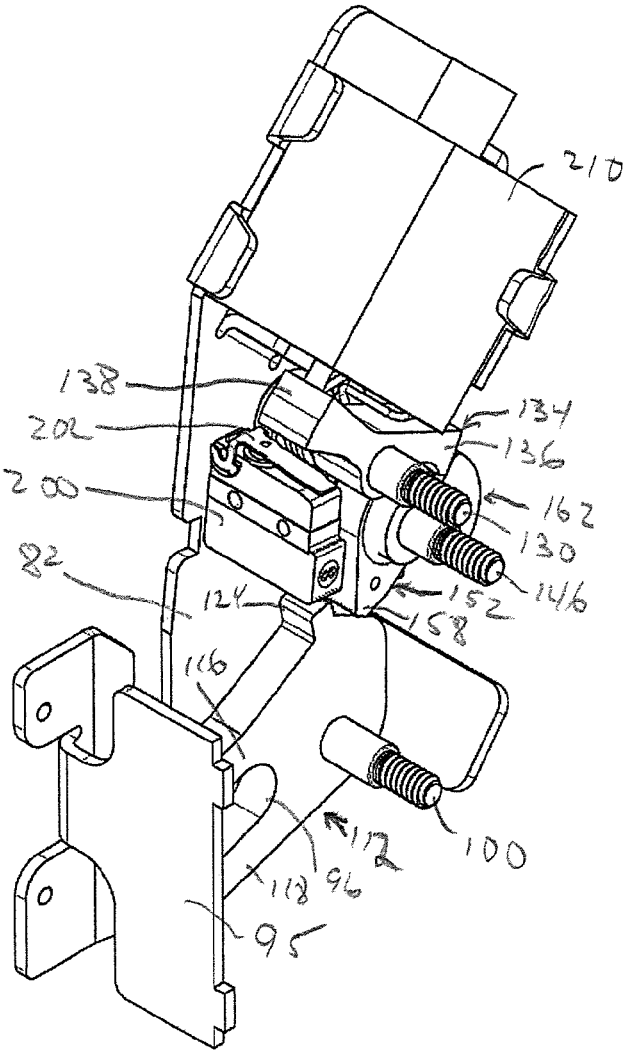
FIG. 16 is a right side perspective view in partial cutaway showing the latch assembly of FIG. 2 a locked position.
Figure 17:
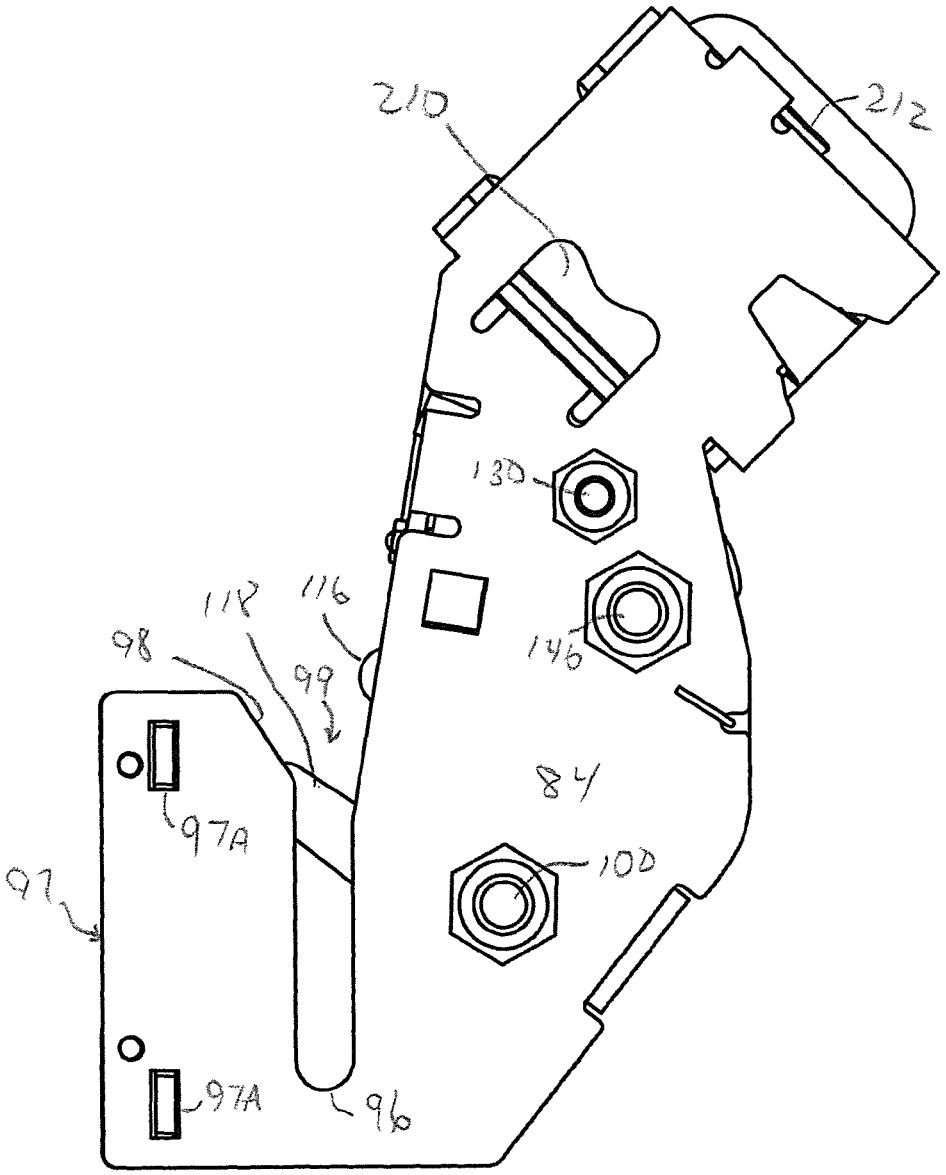
FIG. 17 is a side elevational view showing the latch assembly of FIG. 2 in an unlocked position.
Figure 18:
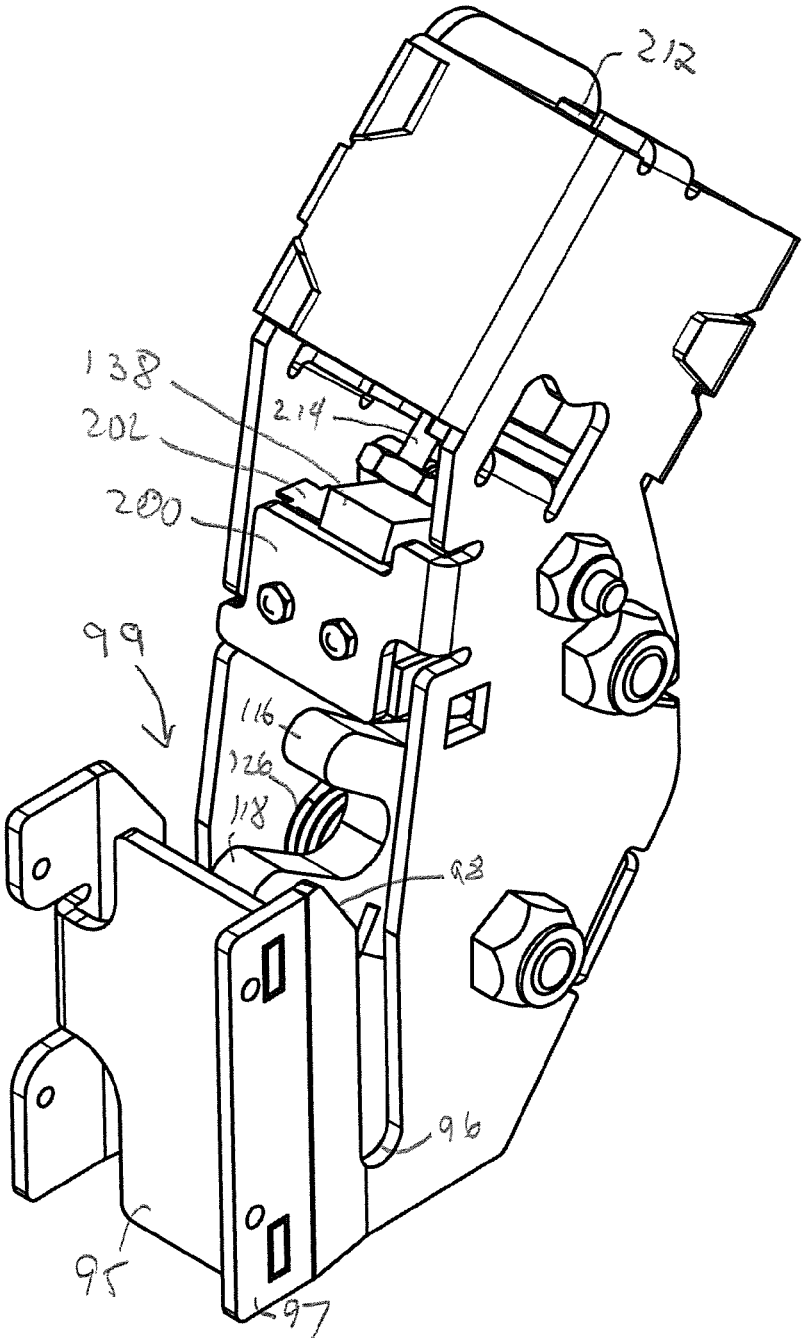
FIG. 18 is a right-rear perspective view showing the latch assembly of FIG. 2 in an unlocked position.
Figure 19:
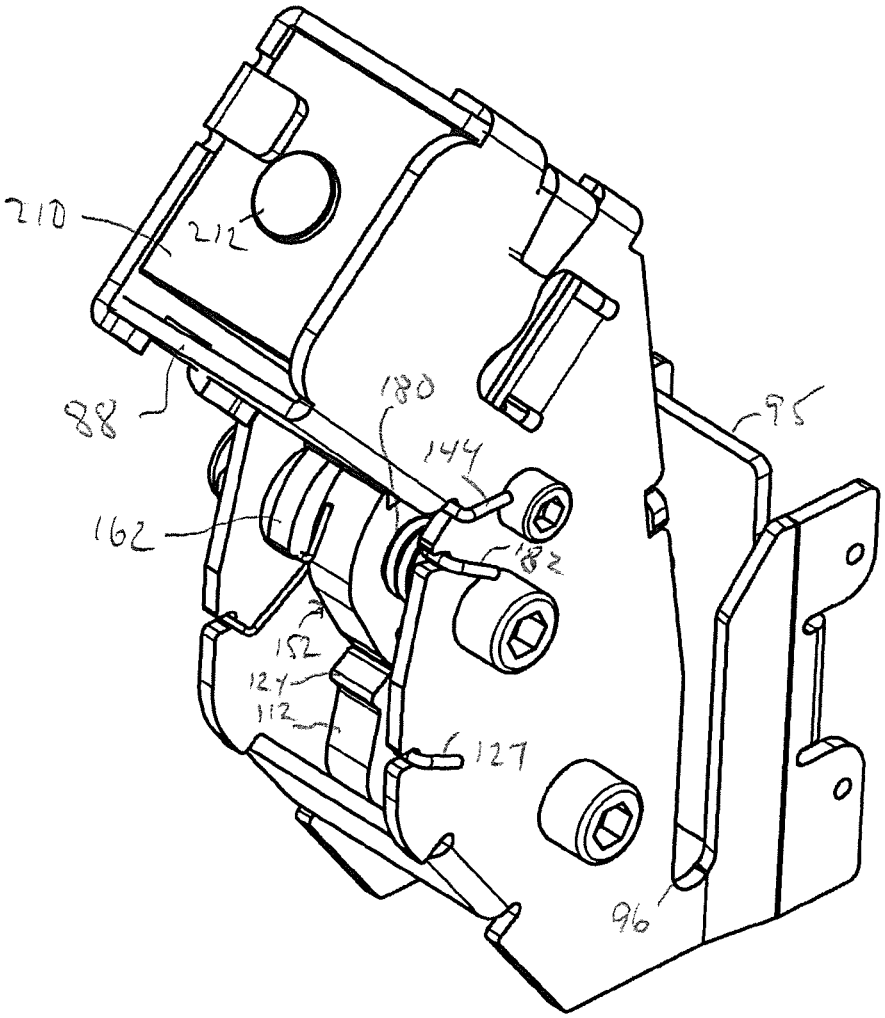
FIG. 19 is a right-front perspective view showing the latch assembly of FIG. 2 in an unlocked position.
Figure 20:
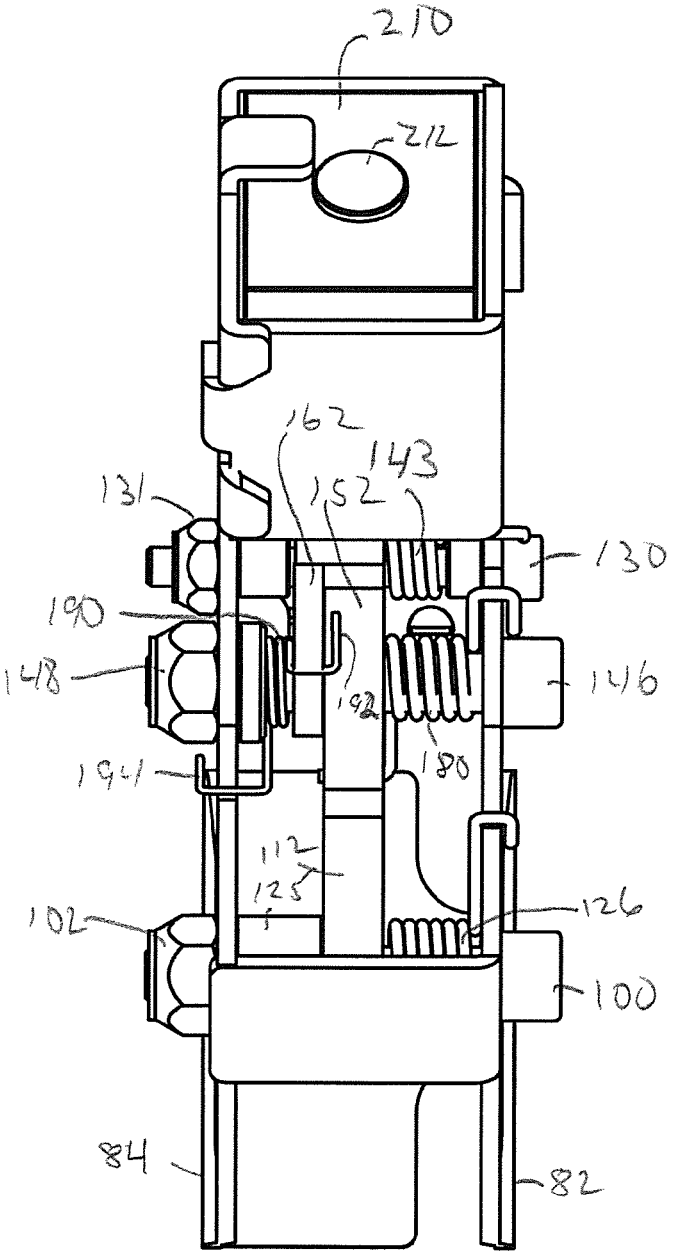
FIG. 20 is a front elevational view showing the latch assembly of FIG. 2 in an unlocked position.
Figure 21:
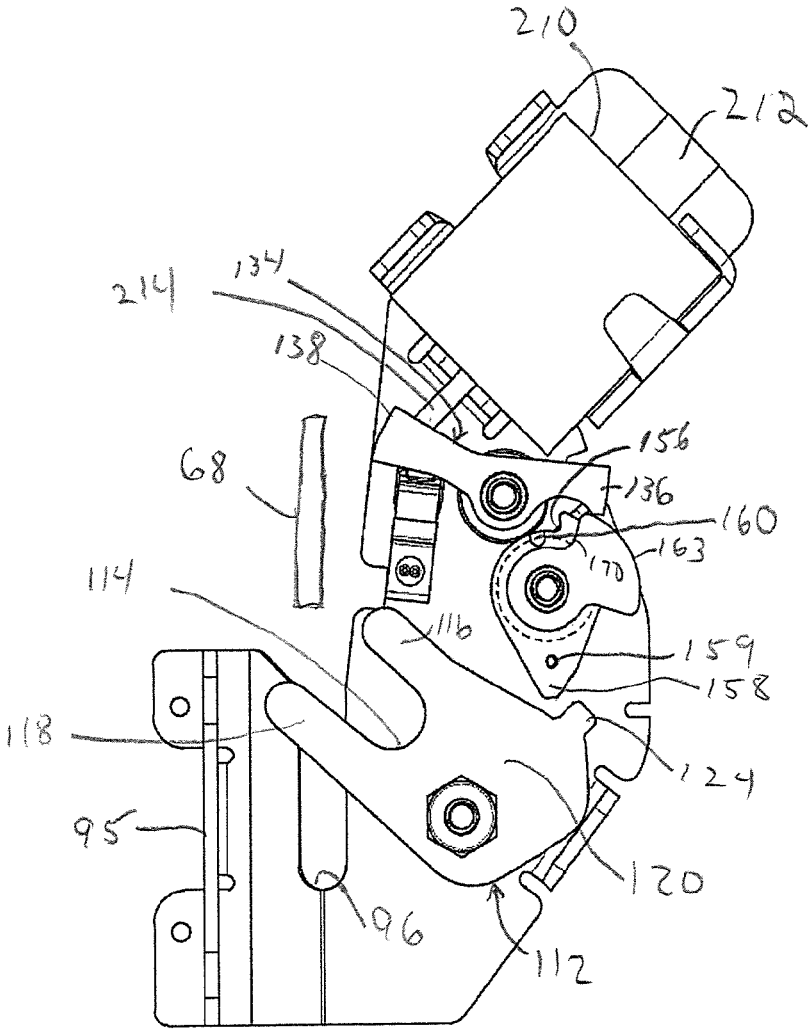
FIG. 21 is a side elevational view showing the latch assembly of FIG. 2 in an unlocked position with a striker member positioned above the slots.
Figure 22:
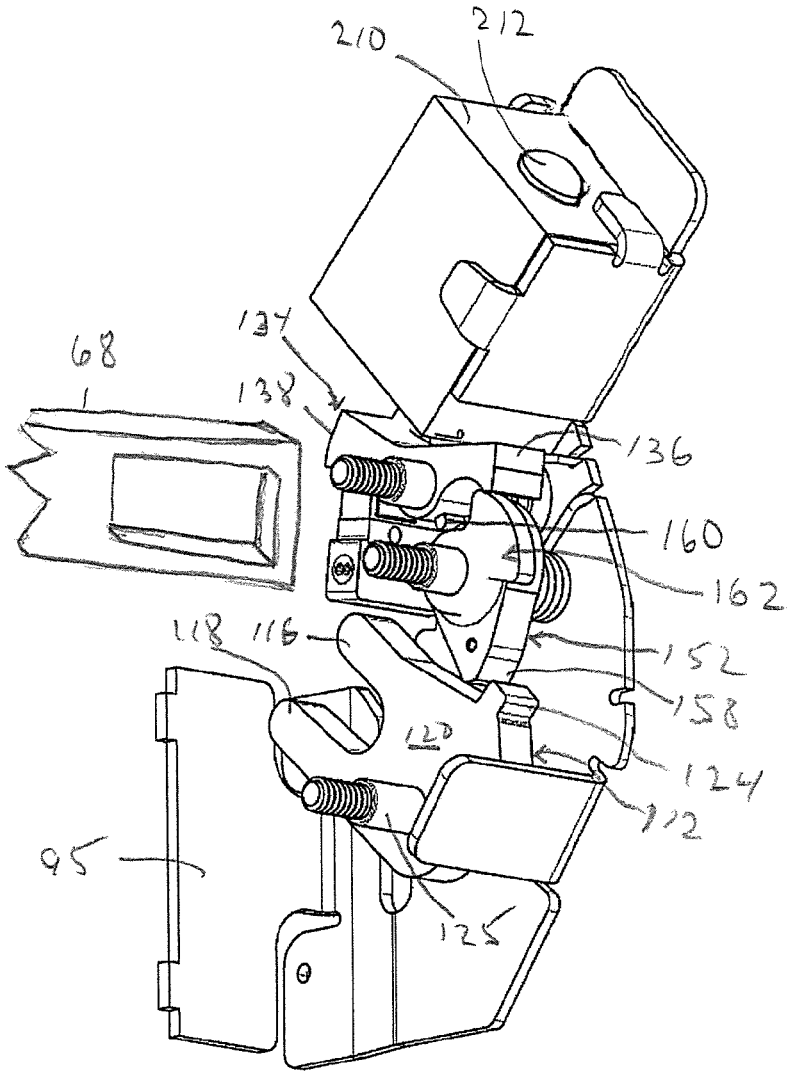
FIG. 22 is a perspective view in partial cutaway showing the latch assembly of FIG. 2 in an unlocked position with a striker member positioned above the slots.

FIG. 9B shows one exemplary embodiment of an electrical communication flow among the major components. The limit switch 200 communicates with the controller 300; the solenoid is activated by an electrical signal (or manually when the button 212 is pressed). When the latch assembly 54 is in a locked state electricity flows from the control panel 310 logic board through the limit switch 200 in a normally closed circuit. The control panel 310 monitors/detects when current is present and the latch assembly 54 is in a locked state. An operator can send a signal through the user interface 306 or an electrical switch 312 to apply voltage (from a power source 314 to the solenoid 210. The current will actuate the solenoid pin 214 to extend, causing the stop arm 136 to rotate and disengage from contact with the contact arm 202. This opens the limit switch 200 circuit, stopping the current flow and also results in the latch assembly 54 being placed into an unlocked state. The control panel 310 detects that the latch assembly 54 is in an unlocked state. When the door 16 is closed and the striker plate 68 engages the latch 112, stop arm 136 contacts the limit switch contact arm 202 and closes the electrical circuit again, and the latch assembly 54 is converted into the locked state, as described hereinabove. It is to be understood that the electrical communication flow can be implemented in a manner in which the circuit is open when the latch assembly 54 is in the locked stated and closed when in the unlocked state.

In one exemplary embodiment, the door 16 further includes a motor for raising and lowering the door 16. The limit switch 200 can be used as or as part of an interlock to electronically communicate (either via the control assembly 300 or directly) with the motor. The limit switch 200 can detect whether the striker plate 68 is engaged with the latch assembly 54 (i.e., the door is locked) and, if so, to not actuate (or to deactuate) the motor, thus avoiding potential overload or burnout of the motor.

An operator of the control assembly 300 can remotely activate the solenoid 210 to unlock the latch assembly 54, or, a user can enter a password on a keypad or other user interface to activate the solenoid 210. If the latch assembly 54 is in the locked position, the operator can cause the control assembly 300 to send an electronic signal to actuate the solenoid 210 and cause the piston 214 to extend, thereby causing stop arm 136 to disengage from the trigger detent 170 and the trigger 162 to pivot counterclockwise. The trigger spring 190 and the cam spring 180 urge the trigger 162 and the cam 152, respectively, to rotate. The first spring 126 causes the latch 112 to rotate, thereby allowing the striker plate 68 to travel upward away from the latch assembly 54 and allowing the door 16 to be raised.

The latch assembly 54 can be manually unlocked from a locked position. A user manually presses the solenoid button 212, causing the piston 214 to extend, which causes the latch assembly 54 unlock, as described hereinabove. Manual unlocking can be an important feature where the door is accidentally lowered and locked and someone is inadvertently locked inside a storage unit (where there may be no accessible user interface) or if there is a power outage that disables the control assembly 300 and the solenoid 300 from operating.

Figure 32:
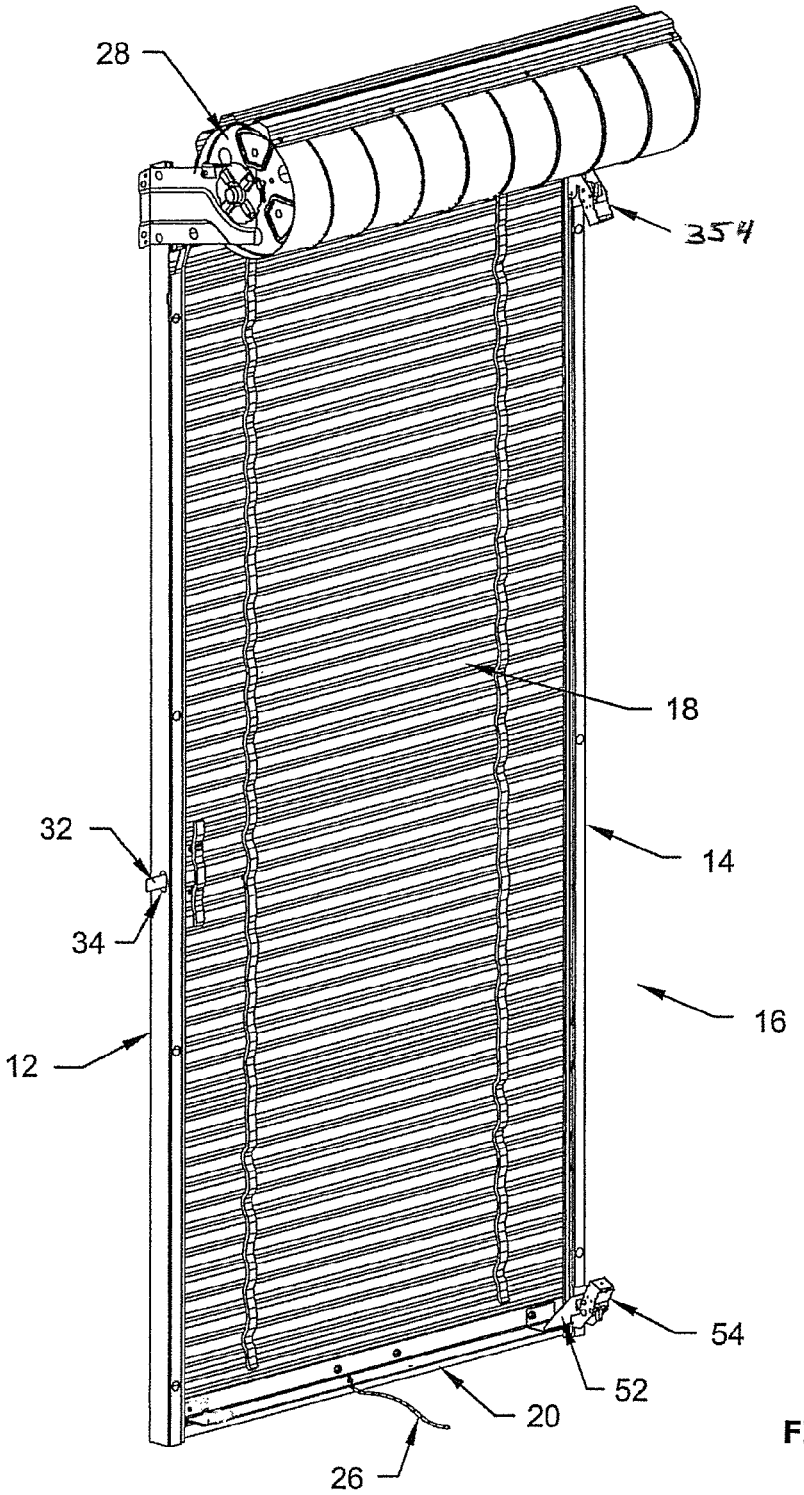
FIG. 32 is a perspective view of an alternative exemplary embodiment showing a first latch assembly 54 and a second latch assembly 354 associated with a door 16.

In an alternative exemplary embodiment, shown in FIG. 32, a rollup door system may include a second latch assembly 354 that is similar the latch assembly 54 but is inverted so that the striker plate 68 enters the latch assembly 354 from the bottom, rather than from the top. In this exemplary embodiment, a latch assembly 54 is mounted at the bottom of the door guide track (or door frame) as described hereinabove, and the second latch assembly 354 is mounted toward the upper part of one of the guide tracks 12, 14 (or door frame). The second latch assembly 354, which is also in electronic communication with the control assembly 300, may be used to maintain the door 16 in an open position where closing (rather than opening) of the door is to be monitored, for example, for a door which is to remain open at all times during business hours, unless closure is authorized by, e.g., security personnel. A facility manager can determine whether the door 16 is in a raised or lowered position because the striker plate 68 will engage either the upper second latch assembly 354 or the lower latch assembly 54, unless the door 16 is in the process of being raised or lowered (or if the door is partially open, which itself can trigger an alarm on the control panel 310 to alert the facility manager that a door has not been opened or closed all the way).

Figure 33:
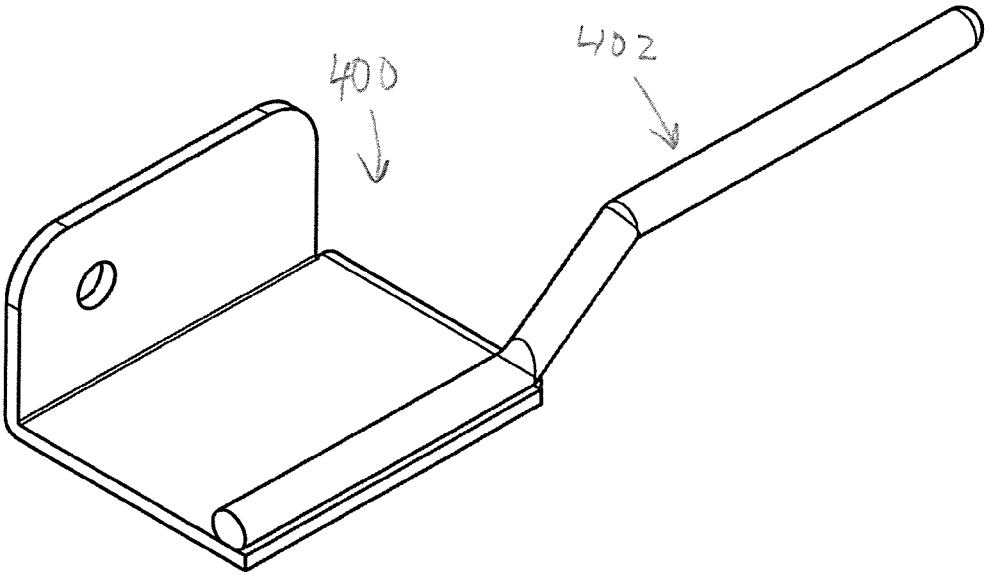
FIG. 33 is a perspective view of an alternative exemplary embodiment of a striker member.
Figure 34:
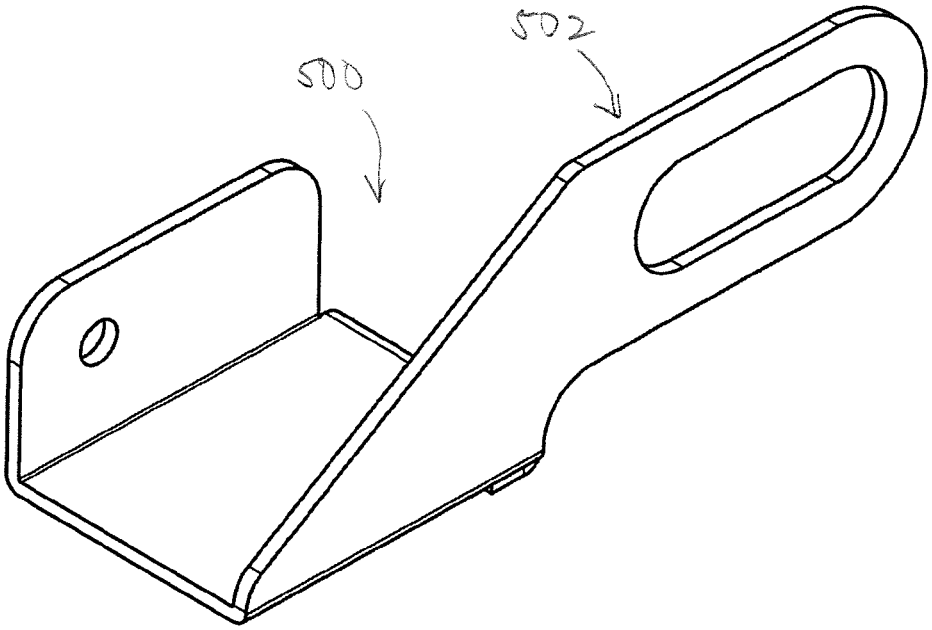
FIG. 34 is a perspective view of another alternative exemplary embodiment of a striker member.

The striker member may be formed in shapes other than as shown with respect to striker member 52 (see FIG. 2). In another exemplary embodiment, shown in FIG. 33 a striker member 400 is constructed having a striker plate 402 formed as a projecting finger, rather than as an opening in a plate. FIG. 34 shows an exemplary embodiment of a striker member 500 having an oval or elongated elliptical shaped striker plate 502. It is to be understood that the striker plate can have any of a number of suitable geometries, including, but not limited to, straight, curved, angled, beveled, or the like. Alternatively, other shaped striker member openings may be used, such as, but not limited to, V-shaped, squared-U-shaped, L-shaped, C-shaped, or the like. Alternatively, the slot may be formed by segments of material extending from a side plate.

Figure 35:
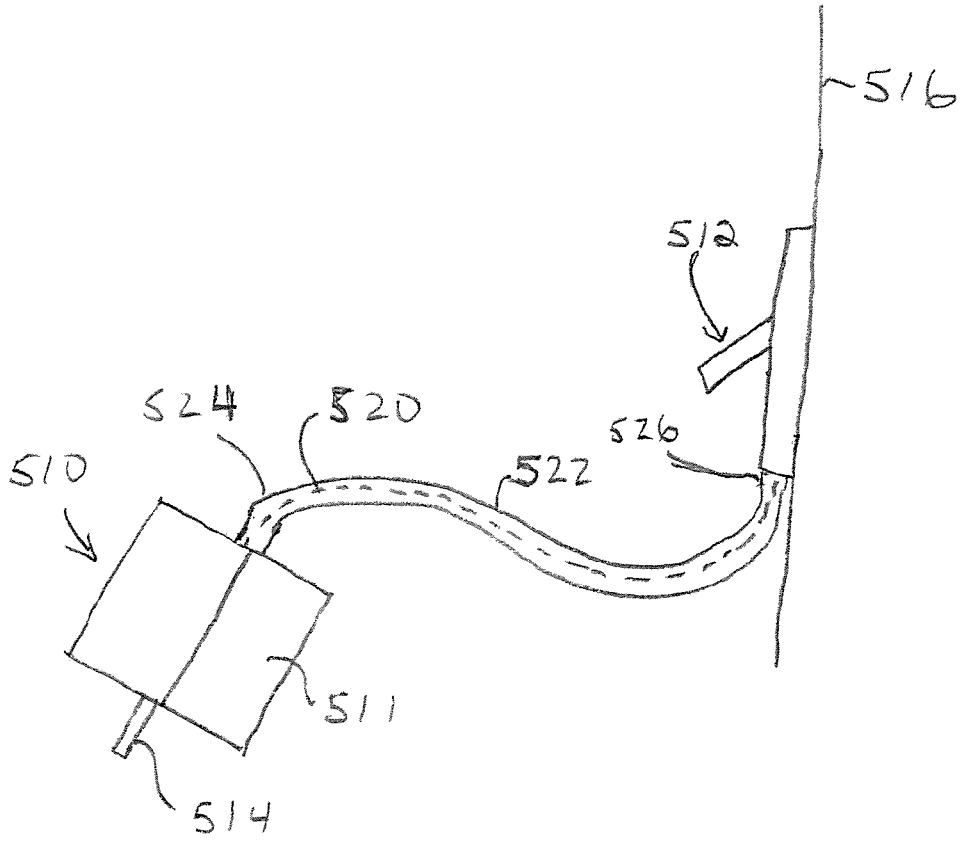
FIG. 35 is a schematic view of an alternative embodiment of a solenoid with a remote activation switch mounted to a wall.

In an alternative exemplary embodiment, shown in FIG. 35, a solenoid 510 (having a basic construction as the solenoid 210) can have a mechanically or electrically activated switch 512 (instead of a button 212) which, when actuated, causes the pin 514 to extend. In exemplary embodiments, the switch 512 can be a lever, button, switch, knob or the like. In exemplary embodiments, the switch 512 can be incorporated with or in the solenoid housing 511. In exemplary embodiments, the switch 512 can be located remotely from the latch assembly 54, such as by being mounted to a wall 516 or door frame or jamb (which is easily locatable by a user), in which case the switch 512 may be in mechanical communication with the solenoid 510. In exemplary embodiments, the mechanical communication may be by a relatively thick wire 520 slidable within a sleeve 522, with one end 524 connected to the switch 512 and the other end 526 connected to the solenoid 510. In this way, a user can actuate the switch 512 and cause the solenoid piston 514 to extend (leading to unlocking of the striker plate 68) without the need for electrical power, in case the power is out. In alternative exemplary embodiments, the switch 512 may be a lever or other means for causing the wire 520 to slide within the sleeve 522. In exemplary embodiments, the electrical communication between the switch 512 and the solenoid 510 may be by a wire connecting the two components.

In another exemplary embodiment, a locking apparatus 600 (shown in FIGS. 36-38) includes the same components as described hereinabove with respect to exemplary embodiments of the locking apparatus 50, with the following distinctions. A latch assembly 601 includes housing 602 includes a first and second side plates 604, 606 and a front plate 608. The first and second side plates 604, 606 do not require a slot similar to slots 96. The front plate 608 has a slot 610 formed therein. The side plates 604, 606 and the front plate 608 define a receptacle area 612. A latch 620 includes a first leg 622 and a second leg 624 that form an opening 626. In exemplary embodiments, the first leg 622 has a length long enough so that when the latch 620 is rotated from an unlocked to a locked position, a portion of the first leg 622 enters the opening 626.

A striker member 630 includes a striker plate 632 having an opening 634 defined therein, and a bottom portion 636 having a bottom edge 638. The striker member 630 may be associated with a rollup door or other structure as described herein. In exemplary embodiments, the striker plate 632 can be rectangular, oval, circular, curved or of other regular or irregular shape. In exemplary embodiments, the striker plate 632 may be configured similar to exemplary embodiments of the striker plate 68 described hereinabove. A feature of exemplary embodiments of the striker member 630 is that the striker plate 632 need not be a horizontal bar (such as the striker plate 68 shown in FIG. 3). Instead the striker plate can be shaped so that it can at least partially be inserted into the receptacle area 612 without the need for side plate slots.

Figure 36:
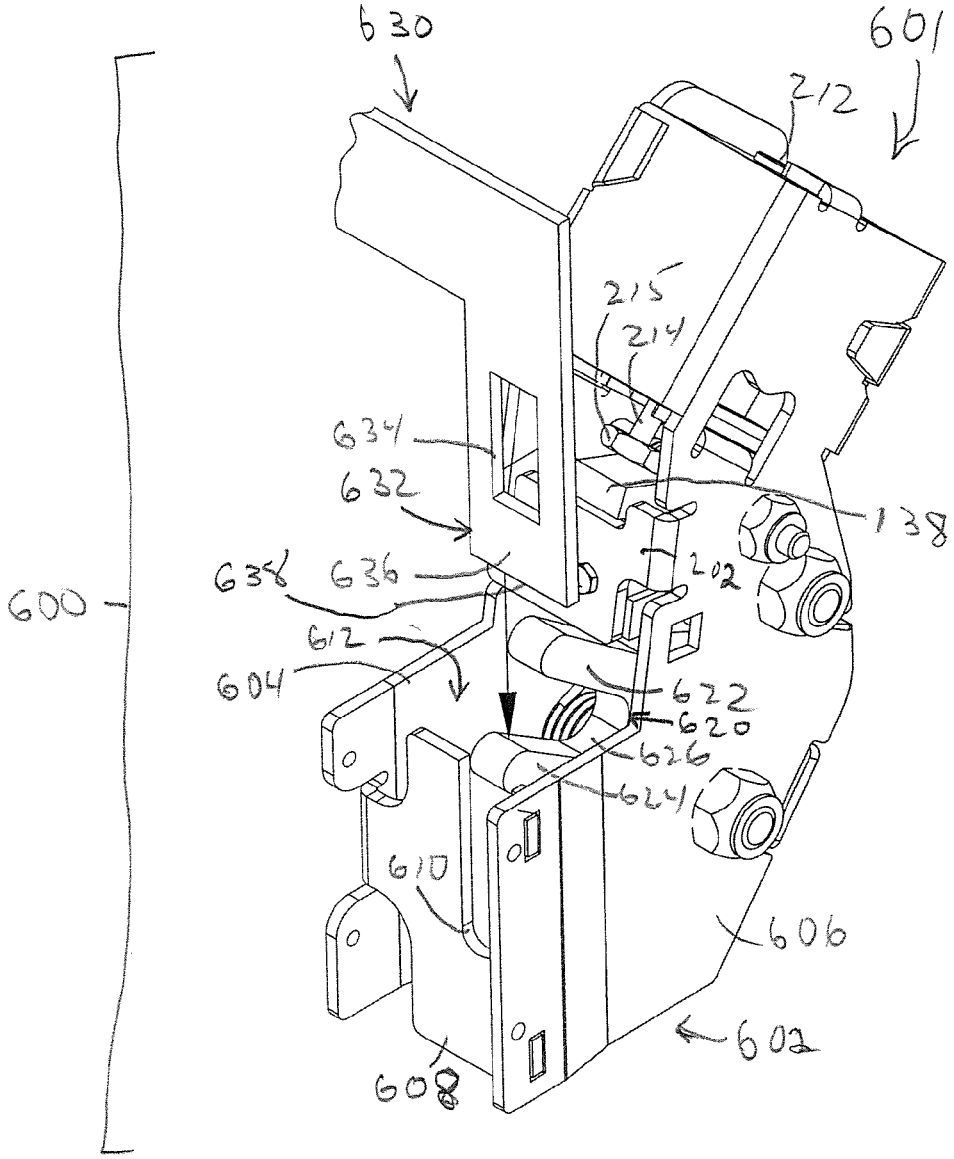
FIG. 36 is a perspective view of an alternative exemplary embodiment of a locking apparatus showing a slot in the front plate, with a latch assembly shown in an unlocked position.
Figure 37:
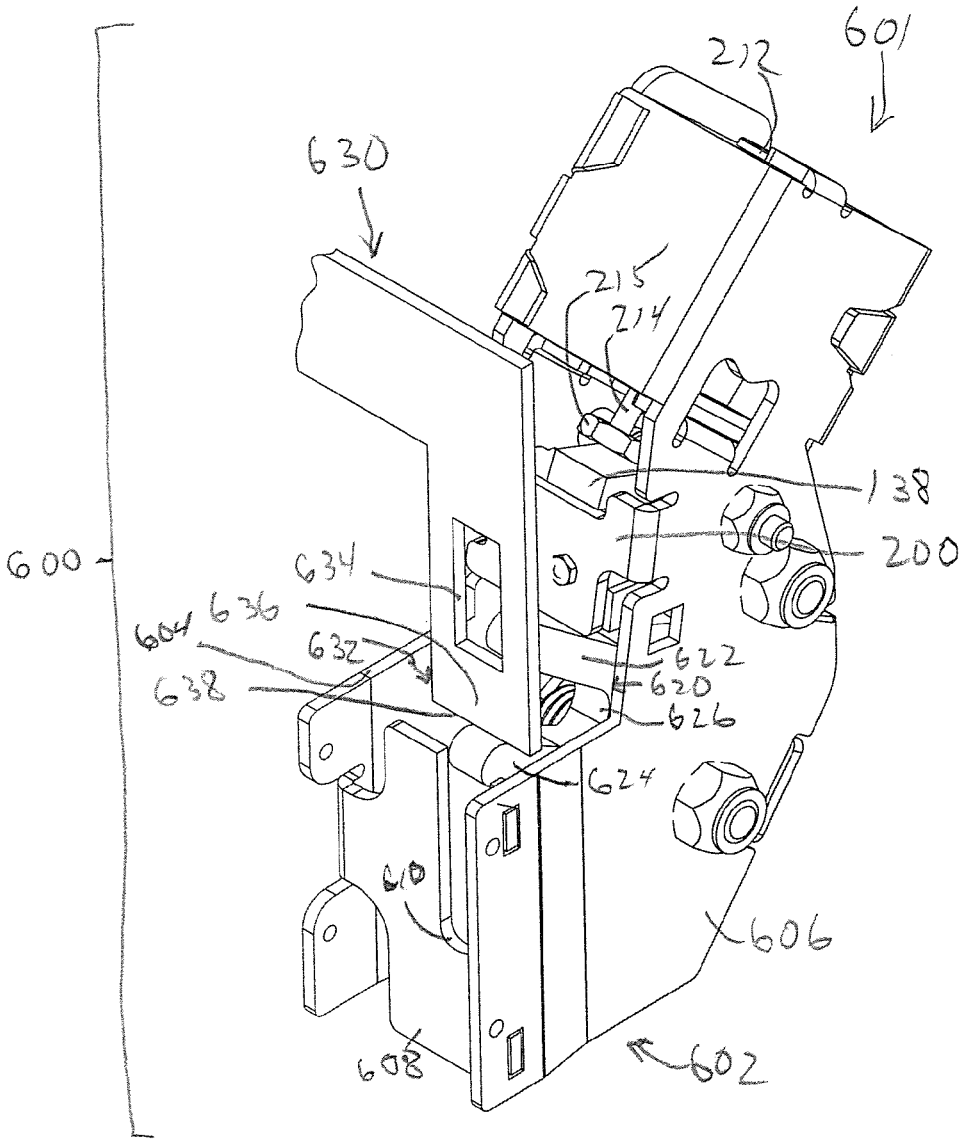
FIG. 37 is a perspective view of the alternative exemplary embodiment of FIG. 36, showing the striker plate partially inserted in the receptacle area in preparation for being locked.
Figure 38:
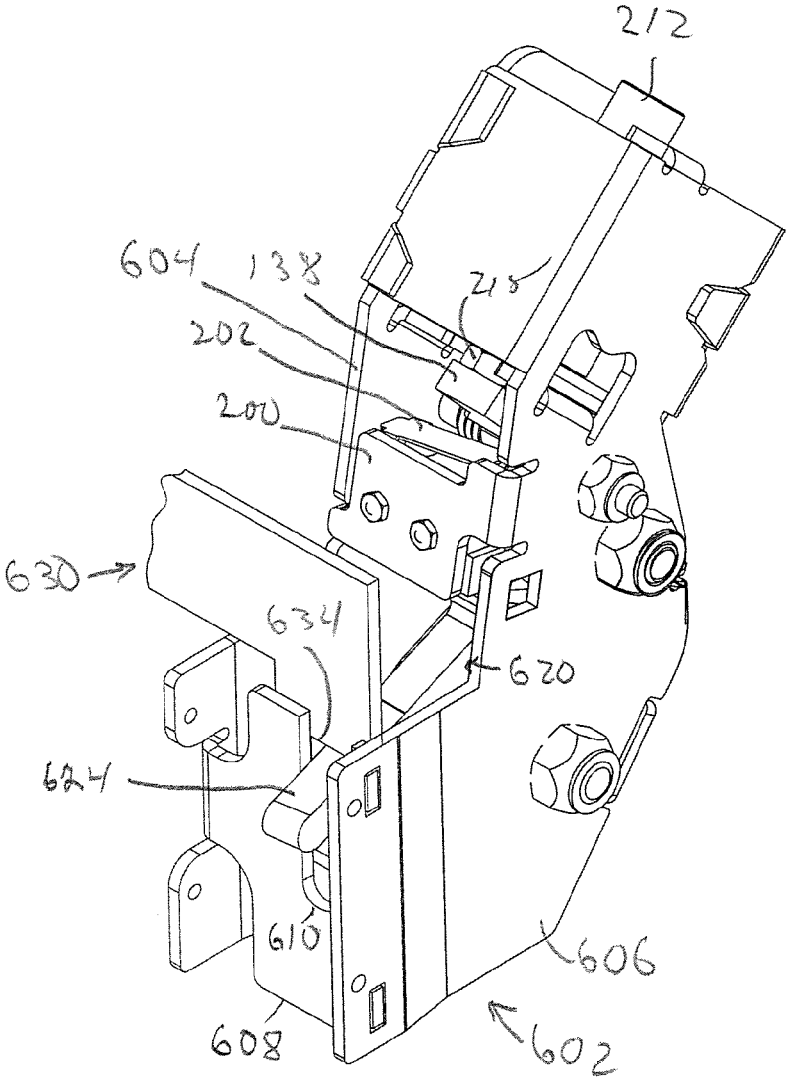
FIG. 38 is a perspective view of the alternative exemplary embodiment of FIG. 36, showing the latch assembly in a locked position.

FIG. 36 shows the latch assembly 601 in an unlocked position, with a striker plate 632 positioned above the receptacle area 612. In this position, the latch 620 is positioned with the first and second legs 622, 624 angled slightly upward. As the striker member 630 is inserted into the receptacle opening 634 (as shown in FIG. 37), the bottom edge 638 contacts the second leg 624 and forces it downward, causing the latch 620 to rotate in a manner similar to that described hereinabove. FIG. 38 shows the striker plate 632 in a locked position at least partially within the receptacle are 612 and positioned so that the striker plate bottom portion 636 is between the first and second legs 622, 624. The first leg 622 is positioned at least partially in the slot 610. In this manner the striker plate 632 is restricted from being removed from the receptacle area 612 by being bounded by the first and second legs 622, 624, and the front plate 608. FIG. 36 shows the solenoid piston 214 in an extended position, while FIG. 38 shows the piston 214 (shown with, in an exemplary embodiment, a pin head 215) in a retracted position, as described hereinabove. FIGS. 36-37 also show the release lever stop arm 138 in contact with the limit switch contact arm 202 when the latch assembly 601 is in the unlocked position. FIG. 38 shows the release lever stop arm 138 rotated to not be in contact with the contact arm 202 when the latch assembly 601 is in the locked position.

Another exemplary embodiment of the present disclosure provides an electronically controlled rollup door system. The system includes a rollup door adapted to move within a pair of opposing guide tracks, at least one striker member as described herein, at least one latch assembly as described herein, and a control assembly as described herein.

In another exemplary embodiment, a method is provided for controlling and managing access to a door from a remote location. A locking apparatus 50 is mounted to a rollup door 16 as described hereinabove. When a storage unit tenant (for example) desires access to the storage unit, the tenant enters his or her access identification information using any of several possible user interfaces 306. The identification information entered by the tenant is compared to a value stored in memory storage 308 (or other location). If the tenant's identification information is validated (e.g., if the tenant is authorized and there is no balance due on the tenant's account), the processor 304 sends a signal to the solenoid 210, which extends the piston 214, causing the latch assembly 54 to unlock the striker plate 68 and allowing the door 16 to be raised. When the tenant recloses and locks the door 16, the striker plate 68 reengages the trigger latch 112 and slots 96 and is locked in place.

The present disclosure also provides in exemplary embodiments a lockable system comprising a movable door or other object, a fixed member (such as a door frame, door jamb, window sill or the like), and a locking apparatus comprising a striker member as described herein according to various exemplary embodiments and at least one latch assembly as described herein according to various exemplary embodiments.

In exemplary embodiments, a locking apparatus and control system as described hereinabove, a user interface may include a display that can indicate to a tenant that rent is overdue and to see the facility manager. Such apparatus and control system may be used to prevent a tenant who is behind on rent from unlocking the door to his or her unit until the past due balance is paid. Accordingly, in exemplary embodiments, a method for managing access to a facility, such as, but not limited to, a storage unit, comprises providing a locking apparatus as described hereinabove. The apparatus includes a control assembly 300 that has user account information stored in memory storage 308. Alternatively, such information may be stored remotely (for example, in the cloud or hosted at a remote server) and accessed over the internet. A user interface queries the user to enter login credentials (for example, user name, password, storage unit number, account number, or other information). Alternatively, a card entry system can be used whereby a card reader is provided that adapted to read a card having the user/tenant's information stored in the card. The card reader is in communication with the control assembly 300 or a remote control center. The card reader can be placed at the entrance gate of, for example, a self-storage facility. Upon detecting a valid card, the card reader may signal the control assembly 300, which in turn can transmit a signal to cause the gate to open. Further, the control assembly can send a signal to a locking apparatus according to one or more exemplary embodiments of the present disclosure so that the locking apparatus unlocks the door and permits a user to raise the door (or cause a motor to be actuated, which will cause the door to be raised). In exemplary embodiments, a software application stored on a mobile device can hold and transmit the user's login credentials, such as by Bluetooth or the like. In exemplary embodiments, a biometric scanner or reader may be used, such as, but not limited to, a fingerprint, retinal, face, or voice reader or scanner. Alternatively, a key and lock may be used.

Upon entry of such login credentials the control assembly validates the credentials against existing stored information for that set of login credentials. If the user is validated, the control assembly may signal the user interface to display a message, for example, "Access Granted" or other message.

The control assembly may signal the solenoid 210, which, as described hereinabove, causes the striker plate to be disengageable from the latch assembly 54, thereby permitting the user to open the door 16. If, on the other hand, the login credentials are invalid, the control assembly 300 may signal a message to display on the user interface indicating invalid credentials (and, e.g., to try again). Alternatively, if the credentials are validated, the control assembly may access the user's account information and, if the account is current (and if there is no other reason to deny access), the door is unlocked. However, if the account shows a balance due, the control assembly may signal the user interface to display a message, e.g., "Account Overdue, Please See Facility Manager for Access," or the like, and prevent the door from unlocking. In exemplary embodiments, the user interface may include a microphone and speaker and the user can actuate the microphone to speak to the facility manager for help. In exemplary embodiments, the user interface may include video communications apparatus for permitting visual and audio communication between the user and a remote facility manager. In exemplary embodiments, the control assembly may be in communication with a remote central station that itself is connected to many facilities, thus enabling a facility manager to be in a remote location and manage access to a large number of units.

A facility manager can monitor access to a number of storage units and determine which units have been accessed and when. The processor can log when the door was opened and reclosed and a report can be generated from the data.

In another exemplary embodiment, the locking apparatus of the present disclosure can be adapted to provide wireless remote access control. Such an apparatus can use the locking apparatus as described hereinabove, but also include a wireless transceiver associated with the solenoid (and may also be associated with the limit switch, if included).

In exemplary embodiments, rather than a door 16 being used, the locking apparatus of the present disclosure can be used or adapted for use with other structures to control access. In exemplary embodiments, the striker may be associated with a movable object and the latch assembly may be associated with a fixed object. For example, the locking apparatus 50 may be used to control access to a window drawer, curtain, partition, or the like. Other structures may include, but are not limited to, sliding doors (double or single), sectional doors, swinging doors, locker systems, and the like. The locking apparatus of the present disclosure can be used with door or other systems that are side or horizontal opening (rather than vertical opening, such as a rollup door system). In exemplary embodiments, the locking apparatus as disclosed herein can be used in many applications and structures that include a fixed structure (for example, a door or window frame, wall, jamb, sill or the like) to which a latch assembly can be mounted and a movable component (such as, but not limited to, a door, window, curtain, or the like) that needs to be secured, with which a striker member can be associated.

Although only a number of exemplary embodiments have been described in detail above, those skilled in the art will readily appreciate that many modifications are possible in the exemplary embodiments without materially departing from the novel teachings and advantages. Accordingly, all such modifications are intended to be included within the scope of this disclosure as defined in the following claims.

While the methods, equipment and systems have been described in connection with specific embodiments, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

As used in the specification and the appended claims, the singular forms "a," "an" and "the" include plural referents unless the context clearly dictates otherwise. "Optional" or "optionally" means that the subsequently described event or circumstance may or may not occur, and that the description includes instances where said event or circumstance occurs and instances where it does not. Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods, equipment and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods, equipment and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following inventive concepts.

Any patents, applications and publications referred to herein are incorporated by reference in their entirety.

What is claimed is:

1. A locking apparatus for a door system, the door system comprising a frame and a movable door having a base member, the locking apparatus comprising:

a. a striker member comprising a mounting portion and a latch-engaging section, the mounting portion being adapted for mounting to the base member; and, b. a latch assembly associated with the frame and comprising i. a housing comprising first and second opposing side members and adapted to receive at least a portion of the striker member latch-engaging section, ii. a latch comprising a body having a bore extending therethrough, a tab extending from the body, a first leg extending from the body and a second leg extending from the body, the space between the first and second legs defining a latch opening, the latch adapted to rotate about a first pin passing through the latch bore, wherein the latch is adapted to releasably engage a portion of the striker member latch-engaging section between the first and second legs, iii. a release lever having a first arm portion, a second arm portion and a middle portion having a bore extending therethrough, the release adapted to rotate about a second pin passing through the release lever bore, and further adapted to releasably engage the latch tab so as to maintain the latch in a locked position when the striker member latch-engaging section is engaged by the latch, iv. a cam comprising a cam body having first side and a second side, an edge, a bore extending through the cam body, a nose portion, a tooth extending from the cam body edge, and a post extending from one side, the cam being adapted to rotate about a third pin passing through the cam bore, wherein the cam nose is adapted to selectively engage the latch tab and the cam tooth is adapted to selectively engage the release lever first arm portion, v. a trigger comprising a body having a first portion with a bore extending therethrough and a second portion having a detent portion, the trigger adapted to rotate about the third pin passing through the trigger bore, wherein the detent portion is adapted to selectively engage the release lever first arm portion, and, vi. a solenoid associated with the housing, the solenoid including an actuation member and a piston, wherein the piston is adapted to selectively contact the release lever second arm portion, wherein when the door is to be locked, the striker member is moved toward the latch assembly and the striker member contacts the latch, whereby the latch rotates and releasably engages the striker member while, as the latch rotates the latch tab contacts the cam tooth and causes the cam to rotate so as to hold the latch in a locked position, thereby locking the striker member in place and maintaining the door in a locked position, and to permit disengagement of the striker member latch-engaging section when the latch assembly is in an unlocked position.

2. The locking apparatus of claim 1, wherein at least a portion of the striker member latch-engaging section is rod-shaped.

3. The locking apparatus of claim 1, wherein at least a portion of the striker member latch-engaging section is a generally flat elongated plate having an aperture defined therein.

4. A locking apparatus for a door system, the door system comprising a frame and a movable door having a base member, the locking apparatus comprising:

a. a striker member comprising a mounting portion and a latch-engaging section, the mounting portion being adapted for mounting to the base member;

b. a latch assembly associated with the frame and comprising i. a housing comprising first and second opposing side members and adapted to receive at least a portion of the striker member latch-engaging section, ii. means for engaging the striker member latch-engaging section iii. a release lever having a first arm portion, a second arm portion and a middle portion having a bore extending therethrough, the release adapted to rotate about a second pin passing through the release lever bore, and further adapted to releasably engage the latch tab so as to maintain the latch in a locked position when the striker member latch-engaging section is engaged by the latch, iv. means for causing the latch-engaging section to rotate and selectively engage the striker member, v. means for selectively engaging the release lever, and, vi. means for causing the release lever to rotate in response to manual actuation or an electronic actuation signal, wherein when the door is to be locked, the striker member is moved toward the latch assembly and the striker member contacts latch, whereby the latch rotates and releasably engages the striker member while, as the latch rotates the latch tab contacts the cam tooth and causes the cam to rotate so as to hold the latch in a locked position, thereby locking the striker member in place and maintaining the door in a locked position and to permit disengagement of the striker member latch-engaging section when the latch assembly is in an unlocked position.

5. The locking apparatus of claim 4, further comprising a limit switch having a contact arm adapted to be selectively contacted by the release lever first arm portion.

6. The locking apparatus of claim 4, further comprising control means for transmitting an actuation signal to the solenoid.

7. The locking apparatus of claim 6, further comprising a control assembly adapted for transmitting an actuation signal to the solenoid, and a wireless transceiver to permit wireless communication between the control assembly and the solenoid.

8. A locking apparatus for a door system, the door system including a movable door including a base member, and a door frame having an upper section and a lower section, the locking apparatus comprising:

a. a striker member having a latch-engaging section and associated with the door base member; and, b. an upper latch assembly associated with the door frame upper section and a lower latch assembly associated with the door frame lower section, each latch assembly comprising i. a housing comprising first and second opposing side members and adapted to receive at least a portion of the latch-engaging section, ii. a latch comprising a body having a bore extending therethrough, a tab extending from the body, a first leg extending from the body and a second leg extending from the body, the space between the first and second legs defining a latch opening, the latch adapted to rotate about a first pin passing through the latch bore, wherein the latch is adapted to releasably engage a portion of the striker member latch-engaging section between the first and second legs, iii. a release lever having a first arm portion, a second arm portion and a middle portion having a bore extending therethrough, the release adapted to rotate about a second pin passing through the release lever bore and further adapted to releasably engage the latch tab so as to maintain the latch in a locked position when the striker member latch-engaging section is engaged by the latch, iv. a cam comprising a cam body having first side and a second side, an edge, a bore extending through the cam body, a nose portion, a tooth extending from the cam body edge, and a post extending from one side, the cam being adapted to rotate about a third pin passing through the cam bore, wherein the cam nose is adapted to selectively engage the latch tab and the cam tooth is adapted to selectively engage the release lever first arm portion, v. a trigger comprising a body having a first portion with a bore extending therethrough and a second portion having a detent portion, the trigger adapted to rotate about the third pin passing through the trigger bore, wherein the detent portion is adapted to selectively engage the release lever first arm portion, and, vi. a solenoid associated with the housing, the solenoid including an actuation member and a piston, wherein the piston is adapted to selectively contact the release lever second arm portion, whereby the striker member can be releasably engaged in a locked or disengaged in an unlocked position by the lower latch assembly when the door is lowered and the striker member can be releasably engaged in a locked or unlocked position by the upper latch assembly when the door is raised.

9. A locking apparatus for use with a movable object and a stationary object, the movable object including a striker member having a latch-engaging section, the locking apparatus comprising:

a. a housing comprising first and second opposing side members and adapted to receive at least a portion of the striker member latch-engaging section, b. a latch associated with the stationary object and comprising a body having a bore extending therethrough, a tab extending from the body, a first leg extending from the body and a second leg extending from the body, the space between the first and second legs defining a latch opening, the latch adapted to rotate about a first pin passing through the latch bore, wherein the latch is adapted to releasably engage a portion of the striker member latch-engaging section between the first and second legs, c. a release lever having a first arm portion, a second arm portion and a middle portion having a bore extending therethrough, the release adapted to rotate about a second pin passing through the release lever bore and further adapted to releasably engage the latch tab so as to maintain the latch in a locked position when the striker member latch-engaging section is engaged by the latch, d. a cam comprising a cam body having first side and a second side, an edge, a bore extending through the cam body, a nose portion, a tooth extending from the cam body edge, and a post extending from one side, the cam being adapted to rotate about a third pin passing through the cam bore, wherein the cam nose is adapted to selectively engage the latch tab and the cam tooth is adapted to selectively engage the release lever first arm portion, e. a trigger comprising a body having a first portion with a bore extending therethrough and a second portion having a detent portion, the trigger adapted to rotate about the third pin passing through the trigger bore, wherein the detent portion is adapted to selectively engage the release lever first arm portion, f. a solenoid associated with the housing, the solenoid including an actuation member and a piston, wherein the piston is adapted to selectively contact the release lever second arm portion, wherein the housing and the latch cooperate to restrict movement of the striker member latch-engaging section when the latch assembly is in a locked position so as to maintain the movable object in a locked position with respect to the fixed object and to permit disengagement of the striker member latch-engaging section when the latch assembly is in an unlocked position so as to permit movement of the movable object.

10. The locking apparatus of claim 9, wherein the movable object is an object selected from the group consisting of a door, window, curtain, partition, and a drawer.

11. A lockable system, comprising:

a. a movable object;

b. a generally fixed frame;

c. a striker member comprising a mounting portion adapted for mounting to the movable object, and a latch-engaging section having a generally vertical portion, and, d. at least one latch assembly associated with the frame, each latch assembly comprising:

i. a housing comprising first and second opposing side members and a portion adapted to receive at least a portion of the vertical portion of the striker member latch-engaging section, ii. a latch comprising a body having a bore extending therethrough, a tab extending from the body, a first leg extending from the body and a second leg extending from the body, the space between the first and second legs defining a latch opening, the latch adapted to rotate about a first pin passing through the latch bore, wherein the latch is adapted to releasably engage a portion of the striker member latch-engaging section between the first and second legs, iii. a release lever having a first arm portion, a second arm portion and a middle portion having a bore extending therethrough, the release adapted to rotate about a second pin passing through the release lever bore and further adapted to releasably engage the latch tab so as to maintain the latch in a locked position when the striker member latch-engaging section is engaged by the latch, iv. a cam comprising a cam body having first side and a second side, an edge, a bore extending through the cam body, a nose portion, a tooth extending from the cam body edge, and a post extending from one side, the cam being adapted to rotate about a third pin passing through the cam bore, wherein the cam nose is adapted to selectively engage the latch tab and the cam tooth is adapted to selectively engage the release lever first arm portion, v. a trigger comprising a body having a first portion with a bore extending therethrough and a second portion having a detent portion, the trigger adapted to rotate about the third pin passing through the trigger bore, wherein the detent portion is adapted to selectively engage the release lever first arm portion, vi. a solenoid associated with the housing, the solenoid including an actuation member and a piston, wherein the piston is adapted to selectively contact the release lever second arm portion, wherein the housing and the latch cooperate to restrict movement of the striker member latch-engaging section when the latch assembly is in a locked position so as to maintain the movable object in a locked position and to permit disengagement of the striker member latch-engaging section when the latch assembly is in an unlocked position.

12. A locking apparatus for a door system, the door system including a frame and movable door having a base member, the locking apparatus comprising:

a. a striker member comprising a mounting portion and a latch-engaging section, the mounting portion being adapted for mounting to the base member; and, b. a latch assembly comprising:

i. a housing comprising first and second opposing side members and adapted to receive at least a portion of the striker member latch-engaging section, ii. a latch comprising a body having a bore extending therethrough, a tab extending from the body, a first leg extending from the body and a second leg extending from the body, the space between the first and second legs defining a latch opening, the latch adapted to rotate about a first pin passing through the latch bore, wherein the latch is adapted to releasably engage a portion of the striker member latch-engaging section between the first and second legs, iii. a release lever having a first arm portion, a second arm portion and a middle portion having a bore extending therethrough, the release adapted to rotate about a second pin passing through the release lever bore, and further adapted to releasably engage the latch tab so as to maintain the latch in a locked position when the striker member latch-engaging section is engaged by the latch, iv. a cam comprising a cam body having first side and a second side, an edge, a bore extending through the cam body, a nose portion, a tooth extending from the cam body edge, and a post extending from one side, the cam being adapted to rotate about a third pin passing through the cam bore, wherein the cam nose is adapted to selectively engage the latch tab and the cam tooth is adapted to selectively engage the release lever first arm portion, v. a trigger comprising a body having a first portion with a bore extending therethrough and a second portion having a detent portion, the trigger adapted to rotate about the third pin passing through the trigger bore, wherein the detent portion is adapted to selectively engage the release lever first arm portion, and, vi. a solenoid associated with the housing, the solenoid including an actuation member and a piston, wherein the piston is adapted to selectively contact the release lever second arm portion, wherein when the door is to be locked, the striker member is moved toward the latch assembly and the striker member contacts the striker member latch-engaging section, which rotates and releasably engages the striker member while, as the latch rotates the latch tab contacts the cam tooth and causes the cam to rotate so as to hold the latch in a locked position, thereby locking the striker member in place and maintaining the door in a locked position and to permit disengagement of the striker member when the latch assembly is in an unlocked position.

* * * * *